US005741079A

United States Patent [19]

Hayama et al.

[11] Patent Number: 5,741,079

[45] Date of Patent: Apr. 21, 1998

[54] PRINTING APPARATUS AND METHOD OF MAKING MASK PATTERN FOR EXPOSURE THEREBY

[75] Inventors: Hitoshi Hayama; Yoshiyuki Yanagisawa, both of Nagano; Kenji Watanabe, Tokyo; Takanobu Kameda, Tokyo; Tomoyuki Shimmura, Tokyo, all of Japan

[73] Assignees: Seiko Epson Corporation; King Jim Co., Ltd., both of Tokyo, Japan

[21] Appl. No.: 786,316

[22] Filed: Jan. 22, 1997

[30] Foreign Application Priority Data

Jan. 23, 1996 [JP] Japan ..... 8-009269
Sep. 4, 1996 [JP] Japan ..... 8-253947

[51] Int. Cl.[6] ..... B41J 2/365

[52] U.S. Cl. ..... 400/120.14; 400/120.09; 347/191

[58] Field of Search ..... 400/120.09, 120.14; 347/188, 189, 191

[56] References Cited

U.S. PATENT DOCUMENTS 5,059,044 10/1991 Takaishi ..... 400/120.14
5,132,709 7/1992 West ..... 400/120.14
5,664,893 9/1997 Meeussen et al. ..... 347/189

FOREIGN PATENT DOCUMENTS 8207345 8/1996 Japan .

*Primary Examiner*—John S. Hilten
*Attorney, Agent, or Firm*—Loeb & Loeb LLP

[57] ABSTRACT

There are provided a printing apparatus and a method of making a mask pattern for exposure by the use of the printing apparatus. A temperature of a thermal head is detected, and a plurality of split pulses formed by dividing a strobe pulse applied to the thermal head are sequentially applied with quiescent periods interposed therebetween. There is stored in advance pulse-applying data of settings of a cumulative period of pulse-applying periods over which the plurality of split pulses are respectively applied, a number of the split pulses, the split pulse-applying periods, and the quiescent periods, defined in a manner corresponding to values of the temperature of the thermal head. Appropriate pulse-applying data is read out according to the temperature detected, and application of the split pulses is controlled according to the appropriate pulse-applying data. In another form, the split pulses are controlled in a manner such that the cumulative period of the split pulse-applying periods is sufficient for a time period over which the strobe pulse is required to be applied.

20 Claims, 24 Drawing Sheets

SQUARE STAMP (SMALL)

SQUARE STAMP (LARGE)

PERSONAL NAME STAMP

BUSINESS STAMP (SMALL)

BUSINESS STAMP (LARGE)

ADDRESS STAMP

MAXIMUM SIZE STAMP

FIG. 20

| DETECTED TEMPERATURE (℃) | PRINT SPEED(mm/sec) | | | |
|---|---|---|---|---|
| | 128 DOTS (3 DIV.) | 88 DOTS (2 DIV.) | 64 DOTS (2 DIV.) | 44 DOTS (UNITARY) |
| ~ 2.5 (0) | 4.0 | 7.0 | 7.0 | 7.0 |
| 2.5 ~ 7.5 (5) | ↑ | ↑ | ↑ | ↑ |
| 7.5 ~ 12.5(10) | 4.5 | ↑ | ↑ | ↑ |
| 12.5 ~ 17.5(15) | 5.5 | ↑ | ↑ | ↑ |
| 17.5 ~ 22.5(20) | 6.0 | ↑ | ↑ | ↑ |
| 22.5 ~ 27.5(25) | 7.0 | ↑ | ↑ | ↑ |
| 27.5 ~ 32.5(30) | ↑ | ↑ | ↑ | ↑ |
| 32.5 ~ 37.5(35) | ↑ | ↑ | ↑ | ↑ |
| 37.5 ~ 42.5(40) | ↑ | ↑ | ↑ | ↑ |
| 42.5 ~ 47.5(45) | ↑ | ↑ | ↑ | ↑ |
| 47.5 ~ 52.5(50) | ↑ | ↑ | ↑ | ↑ |
| 52.5 ~ 57.5(55) | ↑ | ↑ | ↑ | ↑ |
| 57.5 ~ 62.5(60) | ↑ | ↑ | ↑ | ↑ |
| 62.5 ~ 67.5(65) | ↑ | ↑ | ↑ | ↑ |

FIG. 22

| DETECTED TEMPERATURE (℃) | 4mm/sec | | 4.5mm/sec | | 5.5mm/sec | | 6mm/sec | | 7mm/sec | |
|---|---|---|---|---|---|---|---|---|---|---|
| | STB (msec) | QUIES-CENT (msec) | STB (msec) | QUIES-CENT (msec) | STB (msec) | QUIES-CENT (msec) | STB (msec) | QUIES-CENT (msec) | STB (msec) | QUIES-CENT (msec) |
| ~ 2.5 (0) | 5.00 | 0.000 | — | — | — | — | — | — | — | — |
| 2.5 ~ 7.5 (5) | ↑ | ↑ | — | — | — | — | — | — | — | — |
| 7.5 ~ 12.5(10) | 4.60 | ↑ | 4.70 | 0.000 | — | — | — | — | — | — |
| 12.5 ~ 17.5(15) | 4.40 | 0.075 | 4.50 | 0.150 | 4.50 | 0.000 | — | — | — | — |
| 17.5 ~ 22.5(20) | ↑ | ↑ | 4.20 | ↑ | 4.15 | 0.225 | 4.20 | 0.000 | — | — |
| 22.5 ~ 27.5(25) | ↑ | ↑ | ↑ | ↑ | 3.40 | 0.250 | 3.50 | 0.300 | 3.40 | 0.200 |
| 27.5 ~ 32.5(30) | ↑ | ↑ | ↑ | ↑ | ↑ | ↑ | 3.20 | ↑ | 3.15 | 0.250 |
| 32.5 ~ 37.5(35) | ↑ | ↑ | ↑ | ↑ | ↑ | ↑ | ↑ | ↑ | 3.00 | 0.275 |
| 37.5 ~ 42.5(40) | ↑ | ↑ | ↑ | ↑ | ↑ | ↑ | ↑ | ↑ | 2.70 | ↑ |
| 42.5 ~ 47.5(45) | ↑ | ↑ | ↑ | ↑ | ↑ | ↑ | ↑ | ↑ | 2.40 | ↑ |
| 47.5 ~ 52.5(50) | ↑ | ↑ | ↑ | ↑ | ↑ | ↑ | ↑ | ↑ | 2.25 | ↑ |
| 52.5 ~ 57.5(55) | ↑ | ↑ | ↑ | ↑ | ↑ | ↑ | ↑ | ↑ | 2.00 | ↑ |
| 57.5 ~ 62.5(60) | ↑ | ↑ | ↑ | ↑ | ↑ | ↑ | ↑ | ↑ | 1.80 | ↑ |
| 62.5 ~ 67.5(65) | ↑ | ↑ | ↑ | ↑ | ↑ | ↑ | ↑ | ↑ | 1.50 | ↑ |

| DETECTED TEMPERATURE (℃) | 128 DOTS (3 DIV.) | | 88 DOTS (2 DIV.) | | 64 DOTS (2 DIV.) | | 44 DOTS (UNITARY) | |
|---|---|---|---|---|---|---|---|---|
| | STB (msec) | QUIES-CENT (msec) | STB (msec) | QUIES-CENT (msec) | STB (msec) | QUIES-CENT (msec) | STB (msec) | QUIES-CENT (msec) |
| ~ 2.5 (0) | 5.00 | 0.000 | 3.75 | 0.000 | 3.50 | 0.000 | 3.40 | 0.000 |
| 2.5 ~ 7.5 (5) | ↑ | ↑ | ↑ | ↑ | ↑ | ↑ | ↑ | ↑ |
| 7.5 ~ 12.5(10) | 4.70 | ↑ | 3.60 | 0.100 | 3.45 | 0.100 | 3.30 | 0.100 |
| 12.5 ~ 17.5(15) | 4.50 | ↑ | 3.45 | 0.150 | 3.25 | 0.100 | 2.90 | 0.125 |
| 17.5 ~ 22.5(20) | 4.20 | ↑ | 3.20 | 0.175 | 2.95 | 0.125 | 2.70 | 0.150 |
| 22.5 ~ 27.5(25) | 3.40 | 0.200 | 3.05 | ↑ | 2.70 | ↑ | 2.65 | ↑ |
| 27.5 ~ 32.5(30) | 3.15 | 0.250 | 2.80 | ↑ | 2.55 | ↑ | 2.50 | ↑ |
| 32.5 ~ 37.5(35) | 3.00 | 0.275 | 2.65 | ↑ | 2.40 | ↑ | 2.35 | ↑ |
| 37.5 ~ 42.5(40) | 2.70 | ↑ | 2.35 | ↑ | 2.25 | ↑ | 2.25 | ↑ |
| 42.5 ~ 47.5(45) | 2.40 | ↑ | 2.10 | ↑ | 2.10 | 0.150 | 2.10 | ↑ |
| 47.5 ~ 52.5(50) | 2.25 | ↑ | 1.95 | ↑ | 1.95 | ↑ | 1.95 | ↑ |
| 52.5 ~ 57.5(55) | 2.00 | ↑ | 1.75 | ↑ | 1.75 | ↑ | 1.75 | ↑ |
| 57.5 ~ 62.5(60) | 1.80 | ↑ | 1.60 | ↑ | 1.60 | ↑ | 1.60 | ↑ |
| 62.5 ~ 67.5(65) | 1.50 | ↑ | 1.40 | ↑ | 1.40 | ↑ | 1.40 | ↑ |

PRINTING APPARATUS AND METHOD OF MAKING MASK PATTERN FOR EXPOSURE THEREBY

BACKGROUND OF THE INVENTION

1. Field of the Invention

This invention relates to a printing apparatus which performs printing by thermal transfer of ink on an ink ribbon to a printing object by the use of a thermal head, and a method of making a mask pattern for exposure by the use of the printing apparatus.

2. Prior Art

Conventionally, there has been proposed a printing apparatus of this kind which applies a strobe pulse to a thermal head at a predetermined voltage over a predetermined time period to thereby generate heat on the surface of the thermal head in an amount proportional to the product of the predetermined voltage and the predetermined time period, and applies the heat to the ink ribbon to effect thermal transfer of ink on the ink ribbon to a printing object with a sufficient adhesion.

In the conventional printing apparatus, the adhesion of ink to the printing object takes precedence over other factors, so that strobe pulses are applied to the thermal head at such a voltage and over such a time period that a sufficient adhesion of ink to the printing object is ensured. In other words, each strobe pulse is applied in such a manner that a sufficient quantity of heat is secured even if the printer is not under favorable operating conditions, e.g. when the thermal head is newly driven for printing or when the ambient (environment) temperature is low.

When the operating conditions of the printer are favorable for printing, the above settings of the strobe pulse application can bring about the inconvenience of an excessive rise in the surface temperature of the thermal head or generation of an excessively large quantity of heat, which results in irreversible thermal deformations, such as wrinkles, formed on the printing object and the ink ribbon. As a result, when the conventional printing apparatus is used to form a mask pattern for use in exposure, which is formed of a negative image of a printed image by thermally transferring a portion of ink coated on a transparent ribbon tape as a base material of an ink ribbon to a printing object, revealing a portion of the transparent ribbon tape corresponding to the printed image, there can be produced thermal deformations on the tape due to the excessively large quantity of heat, so that the negative image is deformed, and hence no longer suitable for the mask pattern for exposure.

SUMMARY OF THE INVENTION

It is a first object of the invention to provide a printing apparatus which is capable of accurately applying heat in the optimal amount required to thermal transfer of ink to an ink ribbon according to conditions of a thermal head, the ink ribbon, and a printing object.

It is a second object of the invention to provide a method of making a mask pattern for exposure by the use of the above printing apparatus, which makes it possible to make a mask pattern for exposure formed by a suitable negative image free from thermal deformations.

To attain the first object, according to a first aspect of the invention, there is provided a printing apparatus having a thermal head, the printing apparatus applying a strobe pulse at a predetermined voltage to the thermal head based on information of dots of an image to be printed, to thereby heat the thermal head, and applying heat by the thermal head to an ink ribbon in an amount enabling thermal transfer of ink on the ink ribbon.

The printing apparatus according to the first aspect of the invention is characterized by comprising temperature-detecting means for detecting a temperature of the thermal head, split pulse-applying means for sequentially applying a plurality of split pulses obtained by dividing the strobe pulse, with quiescent periods respectively interposed between the plurality of split pulses, pulse-applying data-storing means for storing pulse-applying data of settings of a cumulative period of split pulse-applying periods over which the plurality of split pulses are respectively applied, a number of the split pulses, the split pulse-applying periods, and the quiescent periods respectively interposed between the plurality of split pulses, which are defined in a manner corresponding to values of the temperature of the thermal head, and control means for reading out appropriate pulse-applying data from the pulse-applying data-storing means according to the temperature of the thermal head detected by the temperature-detecting means, and controlling operation of the split pulse-applying means according to the appropriate pulse-applying data.

From the theory of operations, the head surface temperature naturally varies between when the printing apparatus is newly driven for printing and immediately after it has been driven for printing. A quantity of heat newly required for attaching ink on the ink ribbon to the printing object with a sufficient adhesion varies with the head surface temperature before starting the printing, i.e. the quantity of heat accumulated on the thermal head before starting the print. According to the printing apparatus of the first aspect of the invention, the head surface temperature is detected, pulse-applying data defined based data of results of actual printing etc. is read out according to results of the detection, whereby it is possible to easily determine a strobe period over which the strobe pulse is required to be applied and a quiescent period which are suitable for obtaining the quantity of heat newly required to be generated on the thermal head. Further, by dividing the strobe pulse into a plurality of split pulses, the strobe period required in obtaining the required quantity of heat is divided into a plurality of split pulse-applying periods whereby the printing is effected through application of each split pulse a plurality of times. The adhesion of ink to the printing object is proportional to the product of the applied voltage and the duration of the pulse. Even if the strobe pulse is applied in a divided manner i.e. as split pulses over respective split pulse-applying periods, the adhesion of ink is not degraded. On the other hand, the head surface temperature drops suddenly or drastically during each quiescent period between adjacent ones of the split pulse-applying periods, whereby an excessive rise in the head surface temperature can be prevented by insertion of each quiescent period.

Preferably, the pulse-applying data is defined in a manner such that the temperature of the thermal head in a heated state is below a predetermined value.

According to this preferred embodiment, the control means can perform control operations for applying heat to the ink ribbon or the like in a required amount with ease according to the pulse-applying data such that a value of the temperature of the thermal head reached after heating is below the predetermined value.

More preferably, the printing apparatus includes ribbon feed means for feeding the ink ribbon, and the pulse-applying data includes data of values of a feed speed of the ink ribbon defined according to the values of the temperature of the thermal head, the control means controlling the ribbon feed means in a manner such that the feed speed of the ink ribbon is changed in response to the temperature of the thermal head detected by the temperature-detecting means, according to the data of the values of the feed speed of the ink ribbon.

According to this preferred embodiment, the control means can perform control operations for preserving an amount of heat received by the ink ribbon per unit area within a predetermined range, by changing the speed of feed of the ink ribbon by the ribbon feed means according to the data of the feed speed of the ink ribbon. This makes it possible to adjust printing operations to overcome the inconvenience of slow accumulation of heat required for attaching ink to the printing object due to a low ambient temperature when the number of dots of an image to be printed is large, i.e. slow down the speed of feed of the ink ribbon, thereby enabling ink to be attached to the printing object with a sufficient adhesion.

To attain the first object, according to a second aspect of the invention, there is provided a printing apparatus having a thermal head, the printing apparatus applying a strobe pulse at a predetermined voltage to the thermal head based on information of dots of an image to be printed, to thereby heat the thermal head, and applying heat by the thermal head to an ink ribbon in an amount enabling thermal transfer of ink on the ink ribbon.

The printing apparatus according to the second aspect of the invention is characterized by comprising temperature-detecting means for detecting a temperature of the thermal head, split pulse-applying means for sequentially applying a plurality of split pulses obtained by dividing the strobe pulse, with quiescent periods respectively interposed between the plurality of split pulses, and control means for determining a time period over which the strobe pulse is required to be applied based on the temperature of the thermal head detected by the temperature-detecting means, and controlling operation of the split pulse-applying means in a manner such that a cumulative period of split pulse-applying periods over which the split pulses are respectively applied is sufficient for the time period over which the strobe pulse is required to be applied.

The printing apparatus according to the second aspect of the invention detects the temperature of the thermal head, and based on results of the detection, the strobe period over with the strobe pulse is applied is determined. Therefore, only a quantity of heat newly required to be generated on the thermal head can be generated. The adhesion of ink to the applied voltage and the duration of the pulse. Even if the application of the strobe pulse is carried out in a divided or intermittent manner, the control of the sum or cumulative period of the (split) pulse-applying periods prevents the adhesion of the ink to the printing object from being degraded. Therefore, the strobe pulse is divided into a plurality of split pulses, and the operations of the split pulse-applying means are controlled such that the sum or cumulative period of split pulse-applying periods is sufficient for a required pulse-applying period of the strobe pulse, whereby it is possible to effect the printing with a sufficient adhesion, and at the same prevent an excessive rise in the temperature of the thermal head by inserting quiescent periods.

Preferably, the control means changes at least one of a number of the plurality of split pulses, the split pulse-applying periods, and the quiescent periods interposed between the plurality of split pulses, to thereby control the temperature of the thermal head in a heated state.

According to this preferred embodiment, at least one of the number of the plurality of split pulse, the split pulse-applying periods, and the quiescent periods is/are changed according to the environment or operating conditions of the thermal head such that the cumulative period of split pulse-applying periods is sufficient for the whole duration of the strobe pulse, whereby the printing is effected with a sufficient adhesion while preventing an excessive rise in the temperature of the thermal head.

Further preferably, the control means controls the operation of the split pulse-applying means such that the temperature of the thermal head in the heated state is below a predetermined temperature.

According to this preferred embodiment, by controlling the temperature of the thermal head below the predetermined temperature, it is possible to apply heat to the ink ribbon or the in an required amount dependent on the conditions or environment of the thermal head. Therefore, the printing object can be printed with the sufficient adhesion of ink, and at the same time a wasteful application of heat can be prevented.

Further preferably, the printing apparatus includes ribbon feed means for feeding the ink ribbon, and the control means controls the ribbon feed means in a manner such that the feed speed of the ink ribbon is changed in response to the temperature of the thermal head detected by the temperature-detecting means.

According to this preferred embodiment, by changing the feed speed of the ink ribbon according to the temperature of the thermal head, it is possible to preserve the amount of heat received by the ink ribbon per unit area within a predetermined range, whereby the printing with the sufficient adhesion of ink can be effected while preventing a wasteful application of heat.

Preferably, when the image includes various types which are different in print width, the control means further includes pulse-applying time-correcting means for correcting the time period over which the strobe pulse is required to be applied, according to the print width.

In general, the number of dots required for clear print of an image is different between when an image is printed on a broad print area and when an image is printed on a narrow print area. Further, a time period required for the clear print of the image, i.e. a time period required for the pulse to be active for obtaining a required quantity of heat varies with the number of dots of the image data. According to the preferred embodiment, the necessary and sufficient number of dots for clear print of an image is determined according to a print width required. Based on the determined number of dots and the detected head surface temperature, the strobe period and the quiescent period can be set to respective values suitable for obtaining the required quantity of heat.

In the printing apparatuses according to the first and second aspects of the invention, it is preferred that the predetermined temperature is a melting point of a material of a ribbon tape of the ink ribbon.

According to this preferred embodiment, when the conditions of the thermal head are favorable, e.g. when the thermal head is continuously driven for printing, the temperature of the thermal head is prevented from rising above the melting point of the material of the ink ribbon, so that it is possible to prevent the ink ribbon from being heated to an excessive temperature, thereby preventing the ink ribbon from undergoing irreversible thermal deformations.

In the printing apparatuses according to the first and second aspects of the invention, it is preferred that the control means sets each of the quiescent periods to zero when the temperature of the thermal head detected by the temperature-detecting means is below a certain temperature lower than the predetermined temperature.

When the detected temperature of the thermal head is lower than a certain value, e.g. when the thermal head is newly driven for printing or when the ambient temperature is low, there can hardly occur an excessive rise in the temperature of the thermal head and thermal deformations caused thereby, such as wrinkles, but rather, the important problem is how to obtain a sufficient quantity of heat in a short time period. In such a case, according to the preferred embodiment, the quiescent periods are set to zero to join the split pulses into a continuous pulse to thereby enable the sufficient quantity of heat to be obtained in a short time period similarly to the case of a conventional strobe pulse continuously applied as a unit.

To attain the second object, according to a third aspect of the invention, there is provided a method of making a mask pattern for exposure, by the use of the printing apparatus according to the first aspect of the invention, wherein heat is given to an ink ribbon comprising a transparent ribbon tape and ink coated thereon, in such an amount as enables thermal transfer of a portion of the ink to a printing object, to thereby form a mask pattern on the ink ribbon, the mask pattern being formed by a negative image of an image to be printed.

To attain the second object, according to a fourth aspect of the invention, there is provided a method of making a mask pattern for exposure, by the use of the printing apparatus according to the second aspect of the invention, wherein heat is given to an ink ribbon comprising a transparent ribbon tape and ink coated thereon, in such an amount as enables thermal transfer of a portion of the ink to a printing object, to thereby form a mask pattern on the ink ribbon, the mask pattern being formed by a negative image of an image to be printed.

As described above, in both of the printing apparatuses according to the first and second aspects of the invention, it is possible to prevent an excessive rise in the temperature of the ink ribbon. Therefore, according to the method of making a mask patter according to the third or fourth aspect of the invention, by thermal transfer of a portion of ink on the ink ribbon including a transparent ribbon tape as a base material to a printing object to remove the portion of ink from the ink ribbon, a mask pattern for exposure which is formed of an appropriate negative image free from thermal deformations can be formed on the ink ribbon.

The above and other objects, features, and advantages of the invention will become more apparent from the following detailed description taken in conjunction with the accompanying drawings.

BRIEF DESCRIPTION OF THE DRAWINGS

FIGS. 7A and 7B are diagrams which are useful in explaining construction of a stamp body of a square stamp, in which:

FIG. 7A shows the stamp body of the square stamp in a state mounted in the pocket; and FIG. 7B shows the bottom of the stamp body of the square stamp;

FIGS. 7C and 7D are diagrams which are useful in explaining construction of a stamp body of a business stamp, in which:

FIG. 7C shows the stamp body of the business stamp in a state mounted in the pocket; and FIG. 7D shows the bottom of the stamp body of the business stamp;

FIG. 20 shows a table of an example of values of settings of the print speed corresponding to ranges of detected values of a thermal head surface temperature;

FIG. 22 shows a table of an example of settings of a strobe period during which a strobe pulse is continuously or intermittently applied and a quiescent period during which the strobe pulse is made inactive, which correspond to the ranges of detected values of the thermal head surface temperature and values of the print speed, in the case of image data having 128 dots for each transverse line;

DETAILED DESCRIPTION

The invention will now be described in detail with reference to the drawings showing embodiments thereof.

Figure 1A:
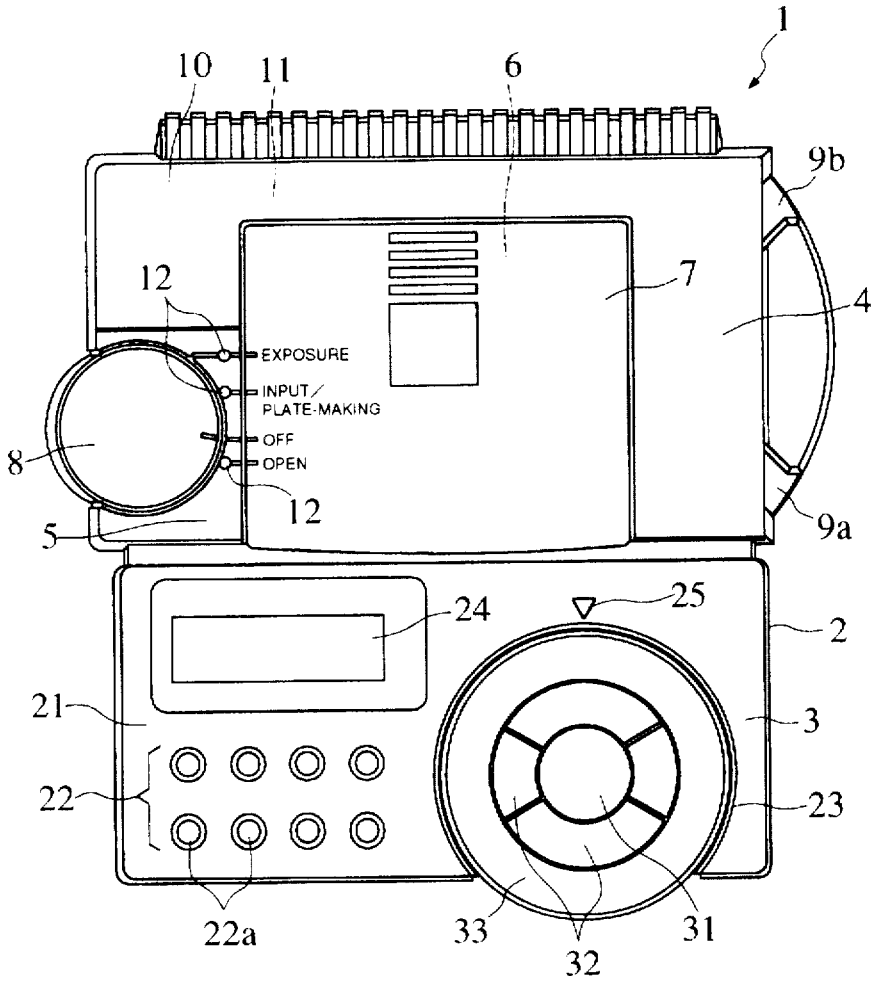
FIG. 1A is a plan view of an appearance of a stamp-making apparatus incorporating a printing apparatus according to an embodiment of the invention.
Figure 1B:
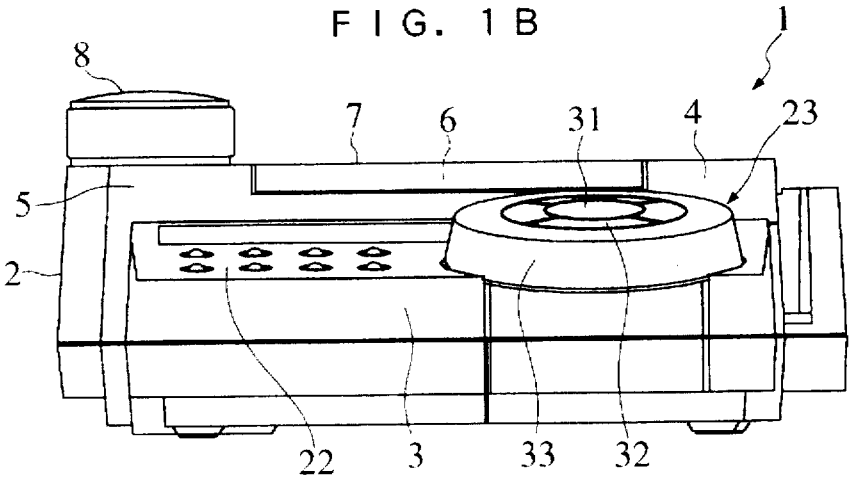
FIG. 1B is a front view of an appearance of the stamp-making apparatus.
Figure 11:
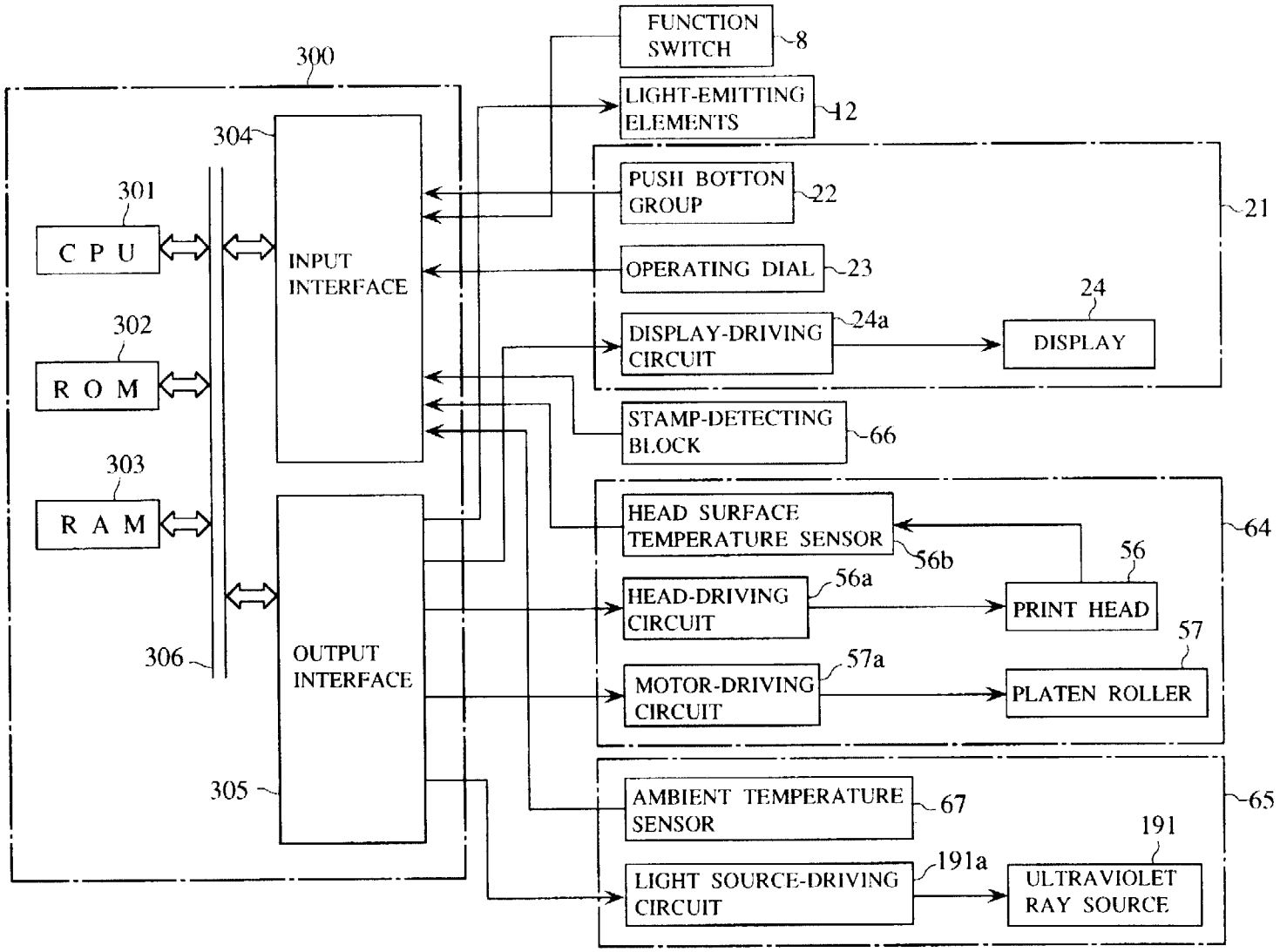
FIG. 11 is a block diagram of a control block and devices connected thereto of the stamp-making apparatus.

Referring first to FIGS. 1A and 1B, there is shown a stamp-making apparatus 1 which incorporates a printing apparatus according to an embodiment of the invention, and carries out the method of making a mask pattern by the use of the printing apparatus. The stamp-making apparatus makes a desired stamp by exposing a stamp body having a stamp surface made of ultraviolet-curing resin to ultraviolet rays via a mask of an ink ribbon printed with a stamp image including images of characters and patterns. The printing apparatus of the invention forms a mask (mask pattern for exposure) on an ink ribbon. FIG. 1A is a plan view of the stamp-making apparatus, while FIG. 1B is a front elevation of the same. FIG. 11 is a block diagram of a control system of the apparatus.

As shown in FIGS. 1A and 1B, the stamp-making apparatus 1 includes a casing 2 having upper and lower divisional portions, an electronic block 3 arranged in a front part of the casing 2, and a mechanical block 4 arranged in a rear part of the same. The mechanical block 4 is comprised of a mechanical block body 5, a pocket 6 formed in a central area of the mechanical block for receiving therein a stamp body A as a stamping-making object material to mount the stamp body A in the mechanical block body 5, and a lid 7 for opening and closing the pocket 6, which is formed with a window.

In a left side portion of the mechanical block 4 as viewed in the figures, a function switch 8 is provided for switching the operation of the stamp-making apparatus 1 between plate-making (printing) and exposure, as well as for permitting the lid 7 to be opened. At respective operating positions of the function switch 8, there are provided indications of "EXPOSURE", "INPUT/PLATE-MAKING", "OFF" and "OPEN", and provided at the operating positions of "EXPOSURE", "INPUT/PLATE-MAKING", and "OPEN" are respective light-emitting elements 12 connected to an output interface 305 of the control block 300.

Further, in a right side portion of the mechanical block 4, there are formed an inserting slot 9*a* for feeding a plate-making sheet B from which is made a stamp character label, referred to hereinafter, and a take-out slot 9*b* for delivering the plate-making sheet B therefrom. Further, the mechanical block 4 has a maintenance cover 10 removably mounted on part thereof outside the pocket 6, and an ink ribbon cartridge 11 carrying an ink ribbon C is mounted under the maintenance cover 10.

The electronic block 3 has an operating block 21 formed on the top thereof and contains the control block 300 therein. The operating block 21 includes a push button group 22 and an operating dial 23 both connected to an input interface 304 of the control block 300, and a display-driving circuit 24*a* connected to the output interface 305 of the control block 300 and a display 24 driven by the display-driving circuit 24*a*.

The operating dial 23 has a trial structure of an execution key 31 having a circular shape and arranged in the center, a cursor/conversion key 32 having four divisional blocks arranged along the outer periphery of the execution key 31 to form an annular shape, and a character input key 33 having an annular shape and arranged along the outer periphery of the cursor/conversion key 32. On the surface of the character input key 33, hirakana characters representative of the Japanese syllabary, not shown, etc. are printed. The inputting of stamp characters is carried out by first setting a character size by pushing a predetermined button 22*a* of the push button group 22, turning the character input key 33 to set each of desired hirakana characters to a triangle mark 25, and pushing the execution key 31 whenever each of the desired hirakana characters is set to the triangle mark 25, followed by converting desired ones of the input hirakana characters to kanji characters by operating the cursor/conversion key 32. When desired stamp characters are formed on the display 24, they are settled.

Figure 2:
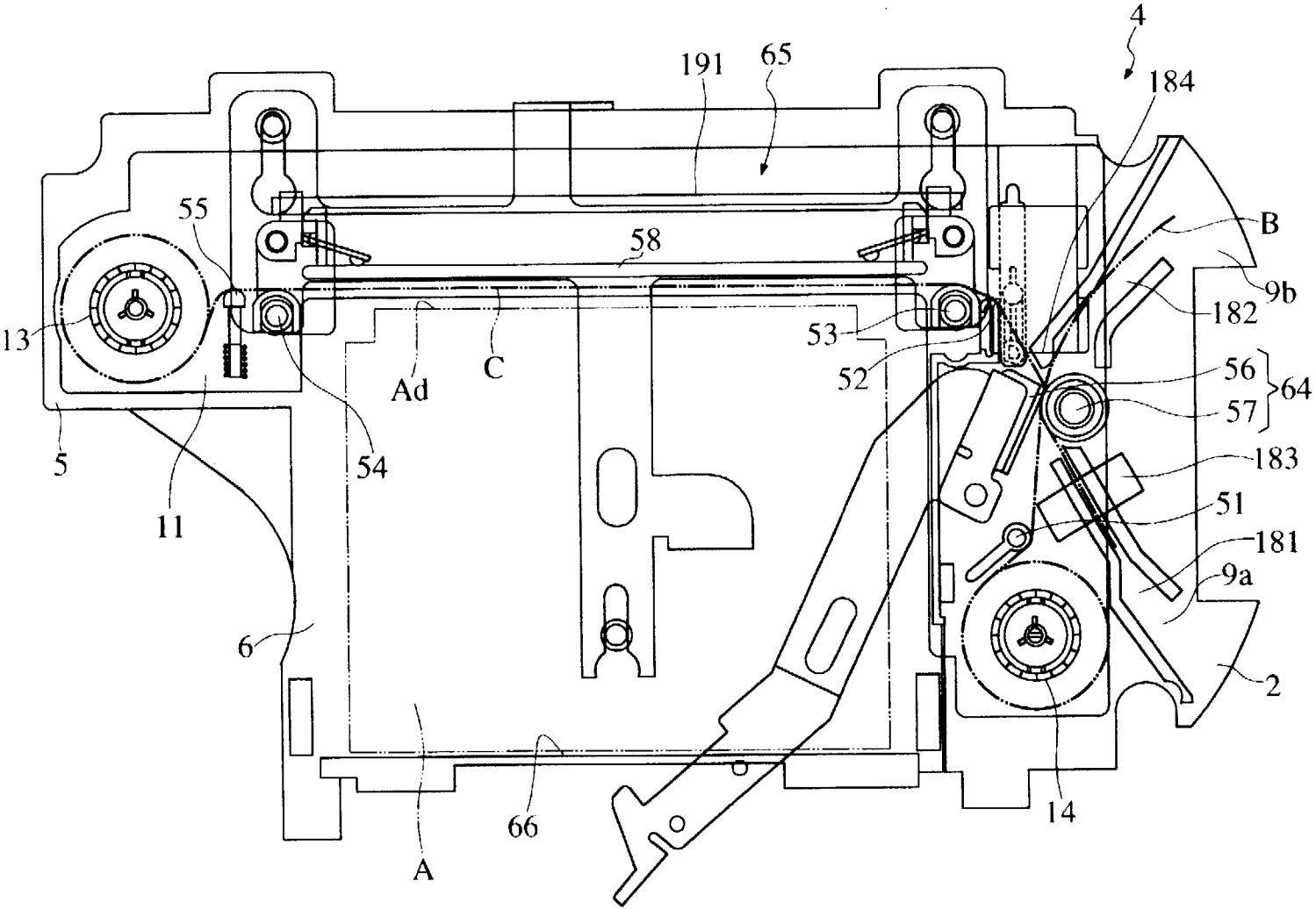
FIG. 2 is a plan view of an internal construction of a mechanical block of the stamp-making apparatus.

Now, a sequence of operations for making a stamp will be briefly described with reference to FIGS. 1A and 1B, and 2. First, the function switch 8 is rotated from "OFF" position as a standby position to "OPEN" position to open the lid 7, and a stamp body A is set in the pocket 6. As the stamp body A is set, the type of the stamp body A is detected by a stamp-detecting block 66 connected to the input interface 304 of the control block 300.

Then, the function switch 8 is rotated to "INPUT/PLATE-MAKING POSITION" to shift the function of the apparatus to plate-making, and the push button group 22 and the operating dial 23 are operated to input stamp characters. When the inputting of stamp characters is completed, the plate-making sheet B on which a stamp character label is provided is set by inserting the same into the inserting slot 9*a*.

Then, a predetermined button 22*a* of the push button group 22 is operated to cause the apparatus to execute the plate-making operation, i.e. printing of the stamp characters. The printing is effected simultaneously on the ink ribbon C and the plate-making sheet B. When the printing is completed, the ink ribbon (printed portion thereof) C is fed or advanced to set the same for exposure to ultraviolet rays, and at the same time plate-making sheet B is discharged from the take-out slot 9*b*. When it is confirmed by the plate-making sheet B discharged that there is no error in the printed stamp characters, the function switch 8 is rotated to the "EXPOSURE" position to shift the function of the apparatus to exposure, thereby causing an exposure block 65, referred to hereinafter, to perform exposure of the stamp body to ultraviolet rays.

When the exposure to ultraviolet rays is completed, the function switch 8 is rotated to the "OPEN" position to open the lid 7, and then the stamp body A is removed from the pocket 6 to wash the same. The washing completes the stamp. Before or after completion of the stamp, the stamp character label is peeled off the plate-making sheet B to attach the same on the back of the stamp.

Next, out of the component parts and elements of the stamp-making apparatus 1, ones associated with the control block 300, described in detail hereinafter, will be described with reference to FIGS. 2 to 11, one by one.

The ribbon cartridge 11 is constructed such that it is removable from the mechanical block body 5, and it is replaceable together with a casing thereof when the ink ribbon C is used up. As shown in FIG. 2, the ribbon cartridge 11 has a take-up reel 13 arranged at one end thereof and a supply reel 14 arranged at the other end thereof. The ink ribbon C is rolled out from the supply reel 14, fed along a feed path in the form of a rotation of an inverted-L shape as viewed in FIG. 2, and taken up by the take-up reel 13. The feed path in the form of a rotation of an inverted-L shape has a shorter side portion which a printing block 64, referred to hereinafter, faces and a longer side portion which the exposure block 65, referred to hereinafter, faces. The printing block 64 faces the ink ribbon C and the plate-making sheet B simultaneously, and the exposure block 65 faces the ink ribbon C printed with the image of the stamp characters.

The ink ribbon C is comprised of a transparent ribbon tape and ink coated thereon. In the present embodiment, it has a thickness of 6 μm. When the printing block 64 of the apparatus carries out printing on the ink ribbon C, a portion of ink coated on the ink ribbon, which defines a character, is transferred to the plate-making sheet B, whereby the ribbon tape of the ink ribbon C is formed with a negative image by a transparent portion from which the portion of ink defining the character has been transferred, while the plate-making sheet B is formed with a positive image by the transferred portion of ink defining the character. The ink ribbon C is sent forward to the exposure block 65 to use the resulting negative image-formed portion thereof as a mask in carrying out the exposure, while the plate-making sheet B is delivered from the apparatus for checking of the stamp characters and affixing the same to the stamp thus made.

Figure 4:
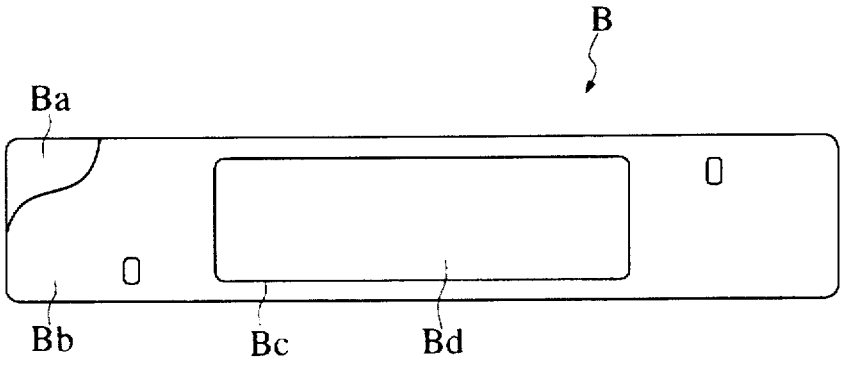
FIG. 4 is a view showing a structure of a plate-making sheet.

As shown in FIG. 4, the plate-making sheet B is a laminate of a base sheet Ba and an adhesive sheet Bb, generally in the form of a strip. The adhesive sheet Bb is formed with cutting lines Bc defining a rectangular area. The rectangular area of the adhesive sheet Bb is peeled off the base sheet Ba along the cutting lines Bc to form the stamp character label Bd to be affixed to the back of the stamp. There are provided several types of the stamp body A which are different in shape from each other according to the use of stamps, and there are also provided respective corresponding types of the plate-making sheet which are different in the shape of an area of the stamp character label Bd (shape and size of an area defined by cutting lines).

Figure 3:
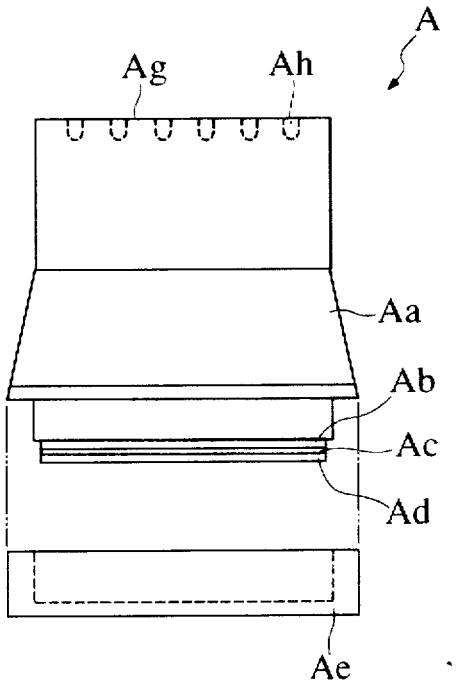
FIG. 3 is a view showing a structure of a stamp body.

On the other hand, as shown in FIG. 3, the stamp body A is comprised of a stock Aa (formed of a resin in the present embodiment), a thin sponge Ab (foamed urethane) affixed to a front end of the stock Aa, an ultraviolet-insensitive resin base Ac affixed to the sponge Ab, and an ultraviolet-curing resin affixed to the resin base Ac to form a stamp surface Ad. The ultraviolet-curing resin portion (stamp surface Ad) of the stamp body A is exposed to ultraviolet rays with the ink ribbon C as a mask, whereby portions of the stamp surface Ad corresponding to the stamp characters are cured. In this state, the stamp body A is taken out of the pocket 6, and washed with water to remove uncured portions of the stamp surface, which are soluble in water, from the stamp surface Ad. Thus the stamp is completed. Symbol Ae in the figure designates a cap made of resin.

Next, the printing block 64 will be described with reference to FIGS. 2 and 11. The printing block 64 includes a head-driving circuit **56*a* and a motor-driving circuit 57*a* both of which are connected to the output interface 305 of the control block 300, the print head (thermal head) 56 driven by the head-driving circuit 56*a* for printing stamp characters on the ink ribbon C, a platen roller 57 for feeding the ink ribbon C in a manner timed to printing operations of the print head 56, and a head surface temperature sensor 56*b* arranged on a head surface of the print head 56. Further, the casing 2 is formed with a feeding passage 181 through which the plate-making sheet B is fed to a contacting area between the print head 56 and the platen roller 57 and a delivery passage 182 through which the plate-making sheet B is delivered. The feeding passage 181 is formed with the inserting slot 9*a* which is open to the outside of the apparatus, at an upstream end thereof, and the delivery passage 182 is formed with the take-out slot 9*b*** which is open to the outside of the apparatus, at a downstream end thereof.

The platen roller 57 is a drive roller as described hereinabove, and when the ink ribbon C is rolled out from the supply reel 14, it pulls in the plate-making sheet B between the print head 56 and itself to thereby bring a portion of the ink ribbon C and a portion of the plate-making sheet B, one upon the other, onto the print head 56. The print head 56 is a thermal head, and thermally transfer ink coated on the ribbon tape of the ink ribbon C to the plate-making sheet B. This transfer of the ink peels portions of ink corresponding to stamp characters off the ink ribbon C to reveal corresponding portions of the transparent base of the ribbon tape, while the peeled portions of the ink are attached to the plate-making sheet B as the stamp characters. The head surface temperature sensor **56*b* is formed by a temperature sensor, such as a thermistor, arranged on a surface of the print head 56 in an intimately contacting manner, and connected to the input interface 304 of the control block 300 for sending information of a temperature of the print head 56** detected thereby.

On the feeding passage 181 faces a sensor 183 which detects insertion of the plate-making sheet B and a feeding reference position of the same. The plate-making sheet B inserted into the feeding passage 181 is sent forward by the platen roller 57 depending on results of the detection of the sensor 183 whereby printing is started from one end of the stamp character label Bd. One of walls defining the delivery passage 182 on a left-hand side as viewed in FIG. 2 is formed with a separating nail 184 at an upstream end thereof, whereby the ink ribbon C and the plate-making sheet B being fed, one upon the other, are separated from each other. Thereafter, the ink ribbon C is sent forward to the exposure block, while the plate-making sheet B is delivered via the delivery passage 182 out of the apparatus.

Next, the exposure block 65 will be described with reference to FIGS. 2 and 11. The exposure block 65 includes a light source-driving circuit **191*a* connected to the output interface 305 of the control block 300, an ultraviolet ray source 191 arranged in a manner opposed to the stamp surface Ad of the stamp body A set in the pocket 6 and driven by the light source-driving circuit 191*a*, and a presser plate 58 arranged between the ultraviolet ray source 191 and the stamp surface Ad of the stamp body A. The ultraviolet ray source 191 is a self-heating hot-cathode tube called a semi-hot tube and supported on a fluorescent tube holder, not shown, provided on a base plate, not shown. The stamp surface Ad of the stamp body A, the presser plate 58, and the ultraviolet ray source 191 are arranged in a manner parallel to each other with a gap between adjacent ones thereof. The ink ribbon C is fed between the stamp surface Ad and the presser plate 58**.

The presser plate 58 is formed e.g. of a transparent resin, and is moved forward (downward as viewed in FIG. 2) to urge the ink ribbon C against the stamp surface Ad of the stamp body A. More specifically, the exposure is carried out by causing the presser plate 58 to urge the ink ribbon C against the stamp surface Ad of the stamp body A, and lighting the ultraviolet ray source 191 to thereby irradiate light to the ink ribbon C through the presser plate 58 (see FIG. 5). The exposure block 65 is provided with an ambient temperature sensor 67 which is formed by a thermistor as the like and connected to the input interface 304 of the control block 300, and sends information of a temperature of ambience of the exposure block 65 detected thereby to the input interface 304.

It should be noted that as the presser plate 58 is translated forward, the first guide pin 53 and the second guide pin 54 are moved in the same direction. This movement decreases the tension of the ink ribbon C stretched between the first and second guide pins 53, 54, whereby the ink ribbon C is urged against the stamp surface Ad of the stamp body A with reduced tension, i.e. without forming any vertical wrinkles thereon.

Now, the above-mentioned state of the ink ribbon C is described in further detail with reference to FIGS. 2 and 5. Referring to FIG. 2, when the ink ribbon C is fed or advanced, the pulling force of the take-up reel 13 causes strong tension of the ink ribbon C, so that vertical wrinkles are formed on the ink ribbon C due to its very small thickness. Therefore, if the ink ribbon C is urged against the stamp surface Ad of the stamp body A as it is, there remain the wrinkles formed on the ink ribbon C urged against the stamp surface Ad, so that deformed images (negative) of the stamp characters on the ink ribbon C are used in carrying out the exposure of the stamp surface Ad to the ultraviolet rays. On the other hand, if the ink ribbon C is loosened, the exposure can be carried out with the images of the stamp characters being out of position. To eliminate these inconveniences, as shown in FIG. 5, the first guide pin 53 and the second guide pin 54 are moved forward in accordance with the forward movement of the presser plate 58, whereby the tension of the ink ribbon C is reduced, and at the same time, a slight stretching force is applied to the ink ribbon C by the tension pin 55, which is moderate enough not to produce any wrinkles on the ink ribbon C.

Figure 5:
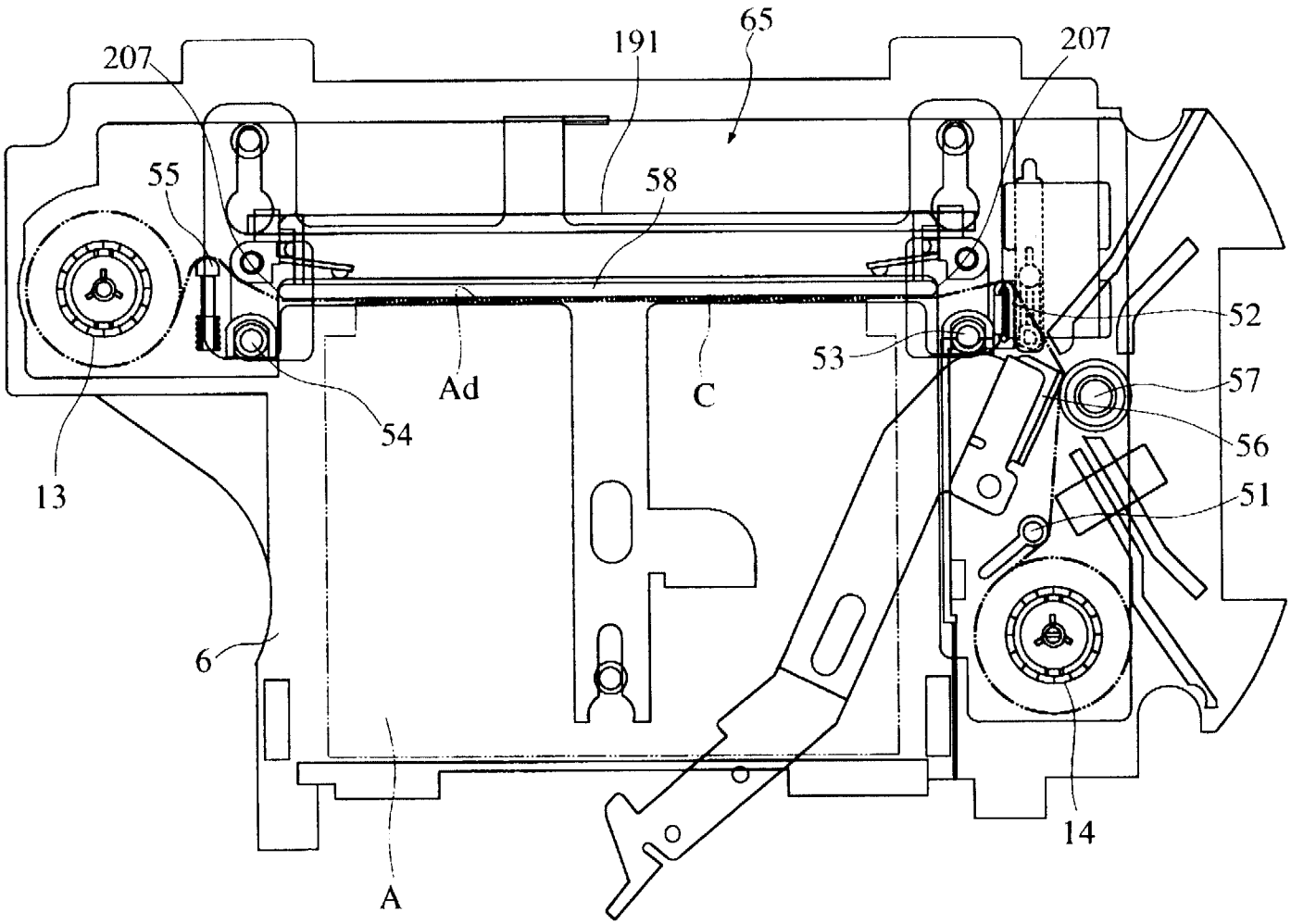
FIG. 5 is a plan view of an exposure system of the mechanical block and component parts associated therewith.
Figure 6:
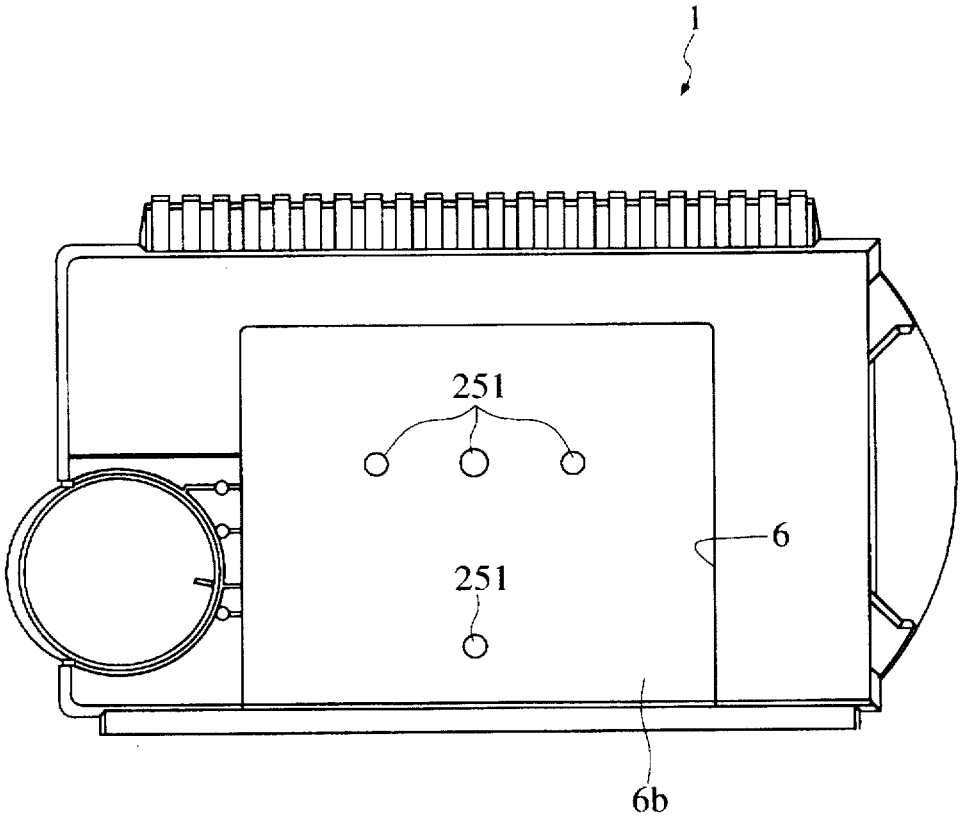
FIG. 6 is a plan view showing a pocket formed in the mechanical block with a lid removed therefrom.

Further, the ink ribbon C in the exposure position shown in FIG. 5 is bent backward at the longitudinal opposite ends of the presser plate 58 by the tension pin 55 and the second path-setting pin 52, and the chamfered portions 207 formed at the longitudinal opposite ends of the presser plate 58 operate to prevent undesired wrinkles from being produced on the ink ribbon C.

As described above, a positive image on the plate-making sheet B and a negative image on the ink ribbon C both formed by the printing are used as a stamp character label and an exposure mask, respectively. That is, the quality of these images directly reflects on the quality of a stamp as a final product. Especially, when the ink ribbon C, which is used as the exposure mask, is deformed, images of deformed characters are formed on the stamp body by the exposure. To eliminate this inconvenience, in addition to mechanical structural means for regulating the tension of the ink ribbon described above, electrical means of adjusting an amount of heat generated by the exposure process, described hereinafter, is provided to thereby preventing undesired wrinkles from being formed on the ink ribbon C.

Next, the stamp-detecting block 66, the operation of which is linked to the opening and closing of the lid 7, will be described. The stamp-detecting block 66 detects the mounting of the stamp body A in the pocket 6, and at the same time discriminates the type of the mounted stamp body A. The stamp body A includes various types having respective different shapes, e.g. ones for a square stamp, a personal name stamp, a business stamp, an address stamp, etc. The different types of stamp bodies A for respective types of stamps are identical in length, but different in width and thickness. It should be noted that the above "length" means a size of the stamp body A between the stamp surface Ad and a surface on an opposite side thereto (back surface Ag), the above "width" means a size of the stamp body A between surfaces of opposite lateral ends thereof in its position mounted in the pocket 6, and the above "thickness" means a size of the stamp body between an upper side surface and a lower side surface of the stamp body in its position mounted in the pocket 6. To set each of these various types of the stamp body A different in width and thickness to a fixed position with respect to the directions along the width and the thickness of the stamp body A, in the present embodiment, as shown in FIGS. 6 and 7A to 7D, four bosses 251, 251, 251, 251, long and short, are provided on the bottom 6*b* of the pocket 6 such that they extend perpendicularly upward from the bottom, and the stamp body A is formed with fitting holes Af for fitting corresponding ones of the bosses therein, respectively.

Figure 7C:
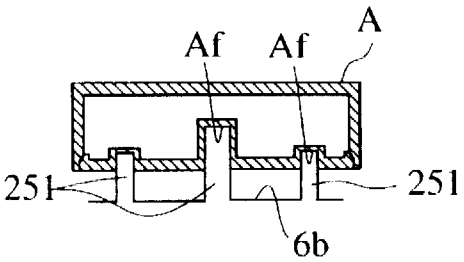
Figure 7D:
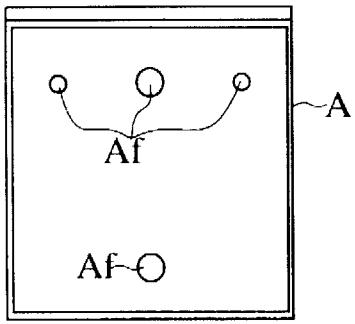
Figure 7A:
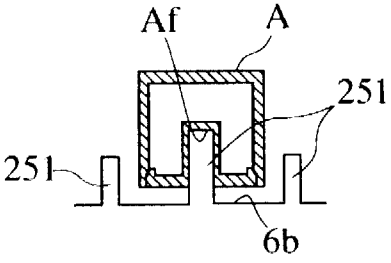
Figure 7B:
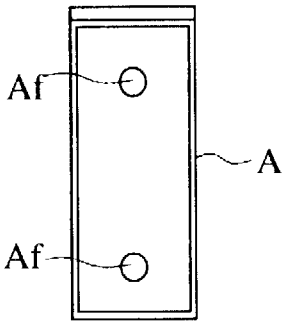
Figure 8A:
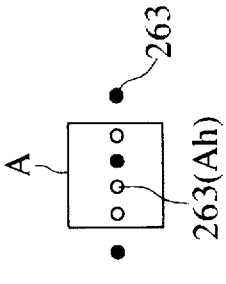
FIG. 8A is a diagram showing a pattern for discriminating a stamp body of a small square stamp.
Figure 8B:
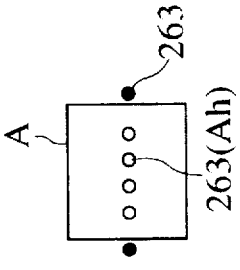
FIG. 8B is a diagram showing a pattern for discriminating a stamp body of a large square stamp.
Figure 8C:
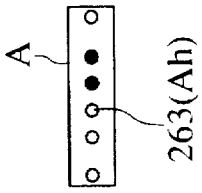
FIG. 8C is a diagram showing a pattern for discriminating a stamp body of a personal name stamp.
Figure 8D:
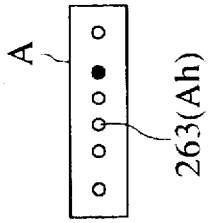
FIG. 8D is a diagram showing a pattern for discriminating a stamp body of a small business stamp.
Figure 8E:
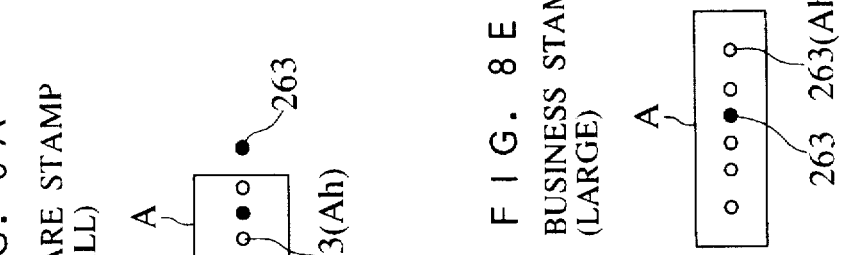
FIG. 8E is a diagram showing a pattern for discriminating a stamp body of a large business stamp.
Figure 8F:
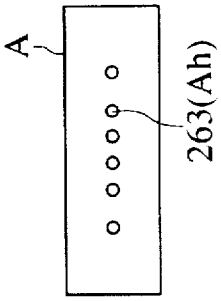
FIG. 8F is a diagram showing a pattern for discriminating a stamp body of an address stamp.
Figure 8G:
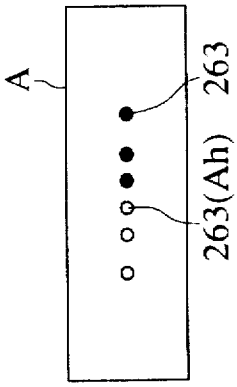
FIG. 8G is a diagram showing a pattern for discriminating a maximum size stamp body.

The four bosses 251, 251, 251, 251 are arranged to form a T shape, and in a manner corresponding thereto, a stamp body A for the square stamp, for example, is formed with two fitting holes Af, Af (see FIGS. 7A and 7B), and a stamp body A for the business stamp, for example, is formed with four fitting holes Af, Af, Af, Af (see FIGS. 7C and 7D). The number of the fitting holes Af and the depth of each of them depend on the type of the stamp body A, and this combination of the fitting holes Ag and the bosses 251 enables each stamp body A to be mounted in the pocket 6 such that the center of the stamp surface Ad of the stamp body A mounted in the pocket 6 is positioned to a fixed location.

Further, the back surface Ag on the opposite side to the stamp surface Ad is formed with a plurality of small holes Ah (type-detecting holes) arranged side by side at respective central locations along the width of the stamp body A. The small holes Ah cooperate with a switch array 262 of the stamp-detecting block 66, described hereinafter, to detect the type of the stamp body A (see FIGS. 8A to 8G). The stamp character label Bd of the plate-making sheet B printed with stamp characters and delivered to the outside of the apparatus separately from the ink ribbon C is affixed to the back surface Ag of the stamp body A, whereby the small holes Ah are concealed.

Figure 9:
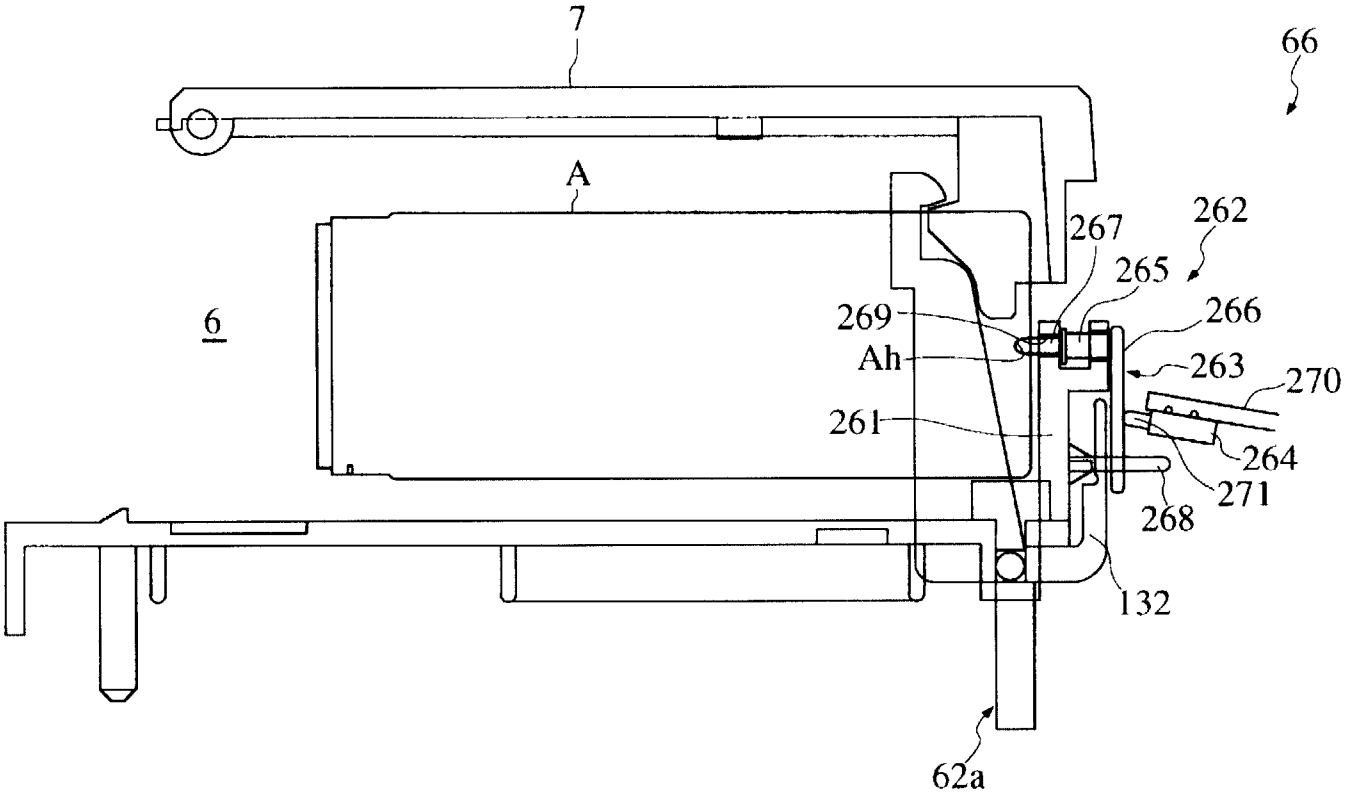
FIG. 9 is a cross-sectional view which is useful in explaining operations of a stamp-detecting block for detecting a stamp body.
Figure 10:
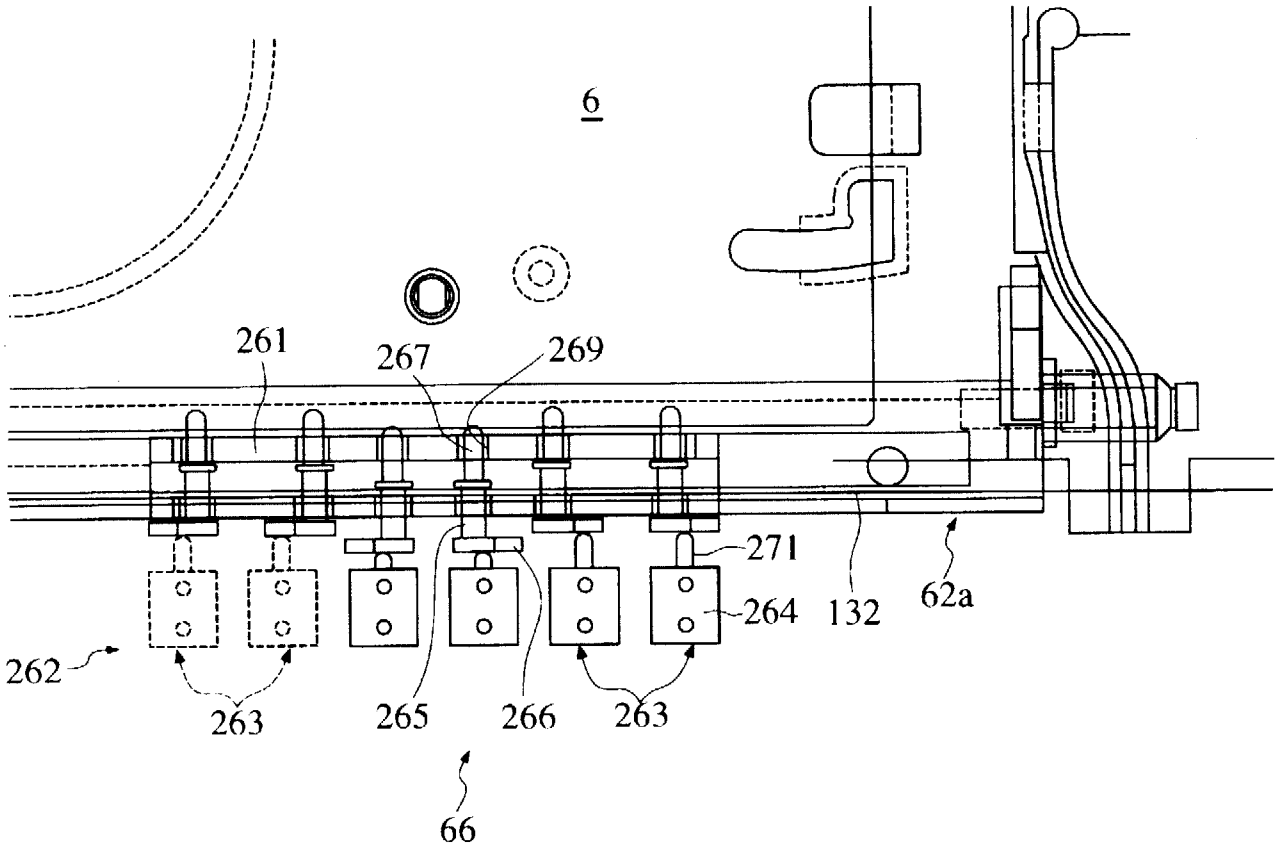
FIG. 10 is a partial plan view showing the pocket, the stamp-detecting block, and component parts associated therewith.

As shown in FIGS. 9 and 10, the stamp-detecting block 66 includes a switch holder 261 (also serving as a wall of the pocket 6) arranged such that it is opposed to the back surface Ag of the stamp body A when it is mounted in the pocket 6, and the switch array 262 formed of six detecting switches 263 supported on the switch holder 261. Each detecting switch 263 is comprised of a switch body 264 formed e.g. of a push switch, and a switch top 265 having one end for being projected into the pocket 6. The switch top 265 includes a plate portion 266 and a detecting projection 267 (including the one end) extending at a right angle to the plate portion 266, with a lower part of the plate portion 266 being guided by a guide projection 268 formed in the switch holder 261 and the detecting projection 267 being guided by a guide hole 269 formed through the switch holder 261 for forward and backward motions thereof.

The switch body 264 is fixed to the reverse side surface of a base plate 270 such that a plunger 271 thereof abuts the plate portion 266 of the switch top 265. The plunger 271 urges the switch top 265 toward the pocket 6 by the urging force generated by its spring, not shown. A state of the one end of the detecting projection 267 projected into the pocket 6 via the guide hole 269 through the switch holder 261, and a state of the same being retracted against the urging force of the plunger 271 correspond to ON-OFF states of the detecting switch 263, respectively. Actually, when any of the detecting switches 263 of the switch array 262 is turned on, mounting of the stamp body A is detected, whereas when all of the detecting switches 263 are turned off, removal of the stamp body A is detected. The detecting switches 263 of the switch array 262 are each in ON or OFF state depending on whether a corresponding small hole Ah exists in the stamp body A. Therefore, the type of the stamp body A can be determined from a pattern of ON/OFF states of the six detecting switches 263.

FIGS. 8A to 8G show the relationship between small holes Ah in the stamp body A and the six detecting switches 263 (detecting projections 267). Provision of the six detecting switches 263 for detecting presence or absence of the small holes Ah makes it possible to detect $2^6-1$, i.e. 63 types of patterns. A stamp body A for a square stamp or the like, which is small in width, has no small holes Ah corresponding to two outermost detecting switches 263, 263 on respective opposite sides, and the two detecting switches 263, 263 project into space at opposite locations outside the stamp body A. That is, a stamp body A having a small width, such as a stamp body A for a square stamp, is recognized by a pattern for a stamp body A having imaginary small holes Ah at outermost locations thereof.

Next, the control block 300 will be described with reference to FIG. 11. The control block 300 is formed e.g. by a microcomputer, and includes a CPU 301, a ROM 302, the input interface 304, the output interface 305, and a system bus 306 connecting all these devices to each other.

The ROM 302 stores various programs, dictionary data for kana-kanji character conversion, font data of characters, symbols, etc. and fixed data, such as data of a predetermined stamp frame. The RAM 303 is used as a working area, and also as means for storing fixed data input by the user. The data stored in the RAM 303 is backed-up even when the power is turned off.

The input interface 304 interfaces to take in signals from the function switch 8, the push button group 22 and the operating dial 23 of the operating block 21, the head surface temperature sensor 56*b* of the printing block 64, the ambient temperature sensor 67 of the exposure block 65, and the stamp-detecting block 66, via the system bus 306 into the CPU 301 or the RAM. The output interface 305 interfaces to deliver control signals and data for use in control operations, which are received via the system bus 306 from the CPU 301, the ROM 302, and the RAM 303, to the light-emitting elements 12, the display-driving circuit 24*a* of the operating block 21, the head-driving circuit 56*a* of the printing block 64, the motor-driving circuit 57*a*, the light source-driving circuit 191*a* of the exposure block 65, etc.

The CPU 301 carries out processing based on input signals from the input interface 304, and processing programs stored within the ROM 302 and selectively executed according to the processing on each occasion, using the RAM 303 as the working area, and reading fixed data stored within the ROM 302 and the RAM 303, as needed.

Figure 12:
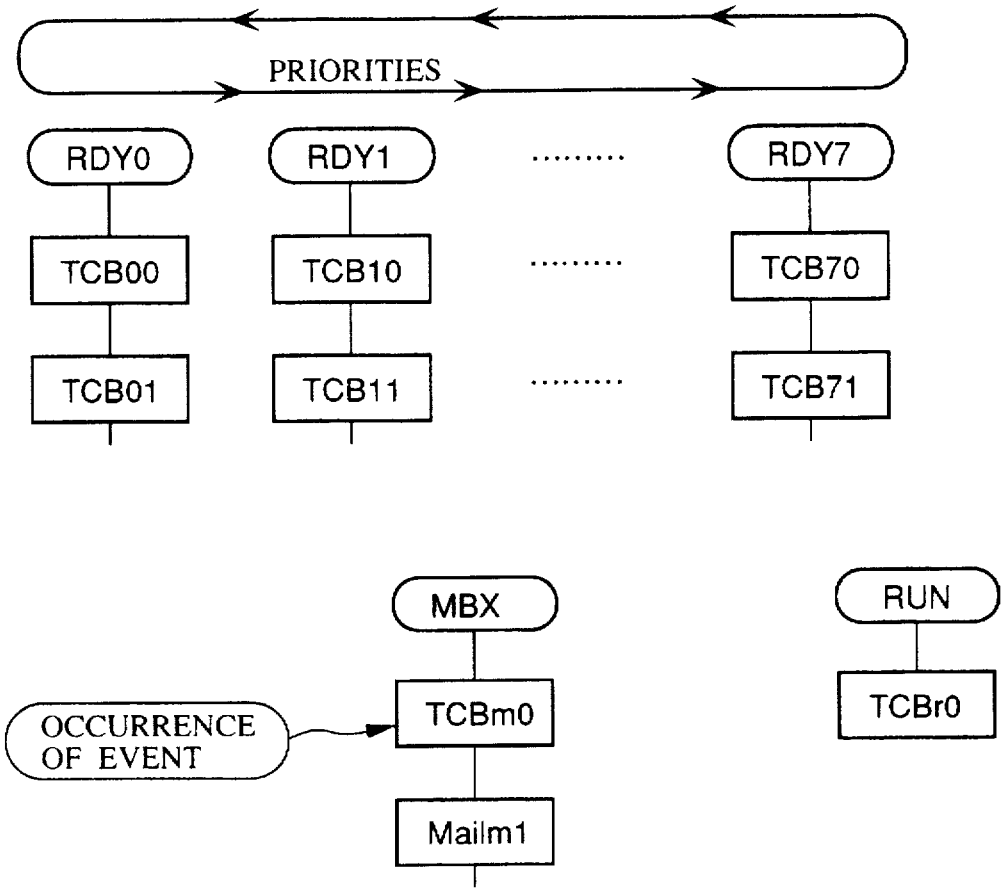
FIG. 12 is a conceptual representation of an outline of multitasking by the stamp-making apparatus.

The stamp-making apparatus 1 of the present embodiment carries out multitask processing in the following manner:

FIG. 12 shows a conceptual representation of the multitasking of the present embodiment. A plurality of tasks to be executed are classified into groups having respective priorities RDY0 to RDYn (in the case of the illustrated example, n=7), and the order of processing of tasks is determined based on the priorities to thereby activates each task. In the following description, tasks assigned the highest priority RDY0 are designated as TCB0i (i=0, 1, 2, . . . ), and tasks assigned the lowest priority are designated as TCB7i. In general, a task assigned the priority RDYj (j=0 to 7) is designated as TCBji. Further, when a task is classified into a group having the priority RDYj, and placed in a wait state in this group, i.e. in the priority, this state will be described e.g. as "a task TCBm0 is registered as TCBj0". When one or more tasks assigned the priority RDYj are registered, it will be expressed as "task existing in RDYj".

Further, as shown in FIG. 12, in the multitasking, an area is set aside for registering a name of each task (e.g. TCBm0 shown in the figure) created for execution in response to an event, such as an interrupt, generated e.g. by depression of any of the push buttons of the push button group 22 or operation of the operating dial 23, and registering a communication task between tasks (e.g. Mailm1 shown in the figure; hereinafter simply referred to as a "mail"). This area will be referred to as "mail box MBX" in the following description. Further, the name of a task representative of the contents of current or actual processing is expressed as TCBr0, and execution of this task for processing is expressed as "the active task run processing", or "the RUN processing" in an abbreviated form. For example, when a task TCB00 is selected and activated, it will be expressed as "the task TCB00 is registered as TCBr0 and activated". This registration is shown as "TCBr0←TCB00" in hierarchical operation diagrams, referred to hereinafter, and flowcharts. The task TCBm0 in the mailbox MBX contains information concerning whether the task TCBr0 currently being executed should be forcedly interrupted or not, and which priority RDYi it should be registered in, and in MBX processing, referred to hereinafter, the task TCBm0 is executed according to these pieces of information.

Figure 13:
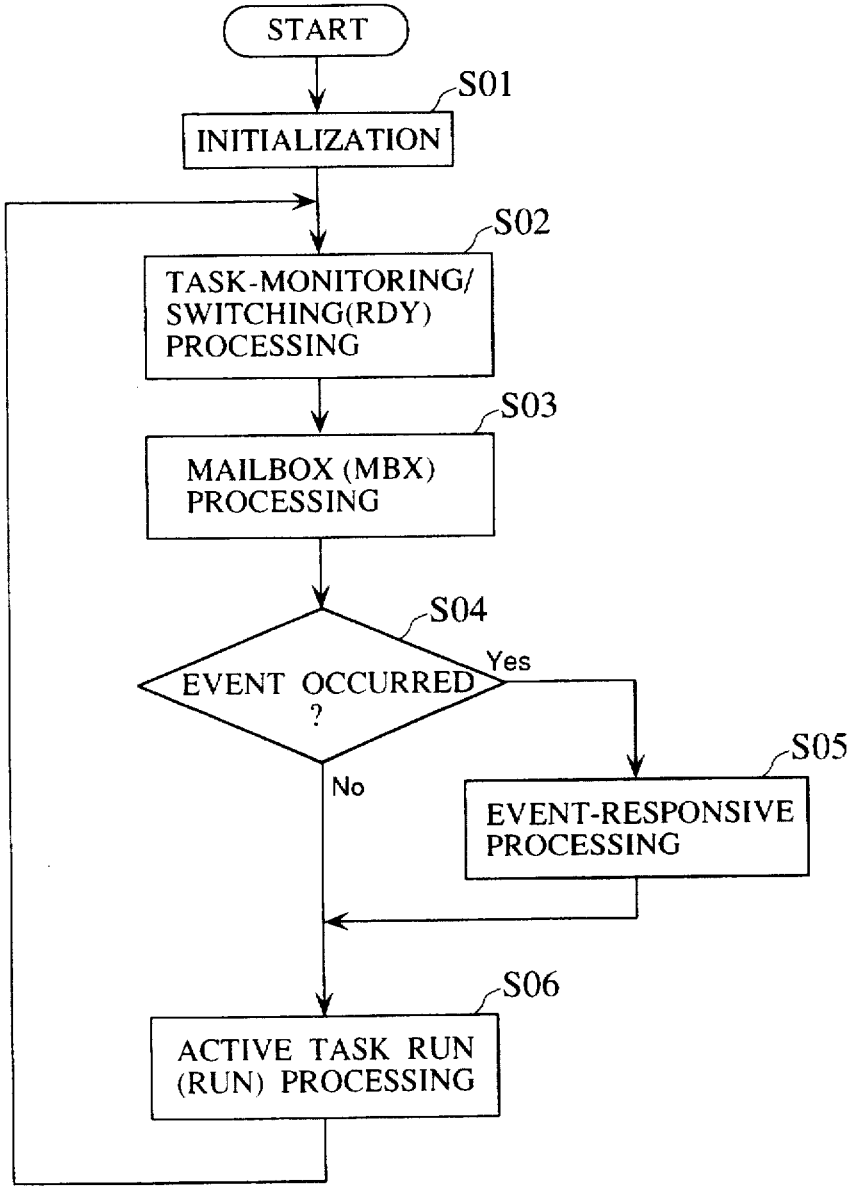
FIG. 13 is a flowchart showing an outline of the overall processing of the stamp-making apparatus.

FIG. 13 shows a procedure of processing executed according to the stamp-making method of the present embodiment, expressed in the form of an ordinary flowchart. As shown in the figure, when the power is turned on to start the processing, first an initialization of each device of the stamp-making apparatus is executed at a step S01, task-monitoring/switching (RDY) processing at a step S02, and mailbox (MBX) processing at a step S03. Then, it is determined at a step S04 whether or not any event has occurred. If an event has occurred, event-responsive processing is executed at a step S05, and thereafter, the active task run (RUN) processing is executed at a step S06. Then, the RDY processing (the step S02) to the RUN processing (the step S06) are repeatedly executed.

However, in the actual processing, the RDY processing and the MBX processing are executed only at predetermined regular timing, but event-responsive processing is started upon occurrence of the event, while the RUN processing is executed during execution of the other processing. Therefore, the present multitasking cannot be expressed accurate enough by the above flowchart, and the hierarchical structure of the program is difficult to understand therefrom. Therefore, in the following description, when a sequence of steps of processing is described, a flowchart is employed which shows a task actually executed by activating another task for the multitasking is shown as a subroutine. Event-driven type tasks, i.e. tasks which are initiated or activated in response to respective events, are described by a description method used in a diagram of FIG. 14 (hereinafter referred to as "the hierarchical operation diagram").

Figure 14:
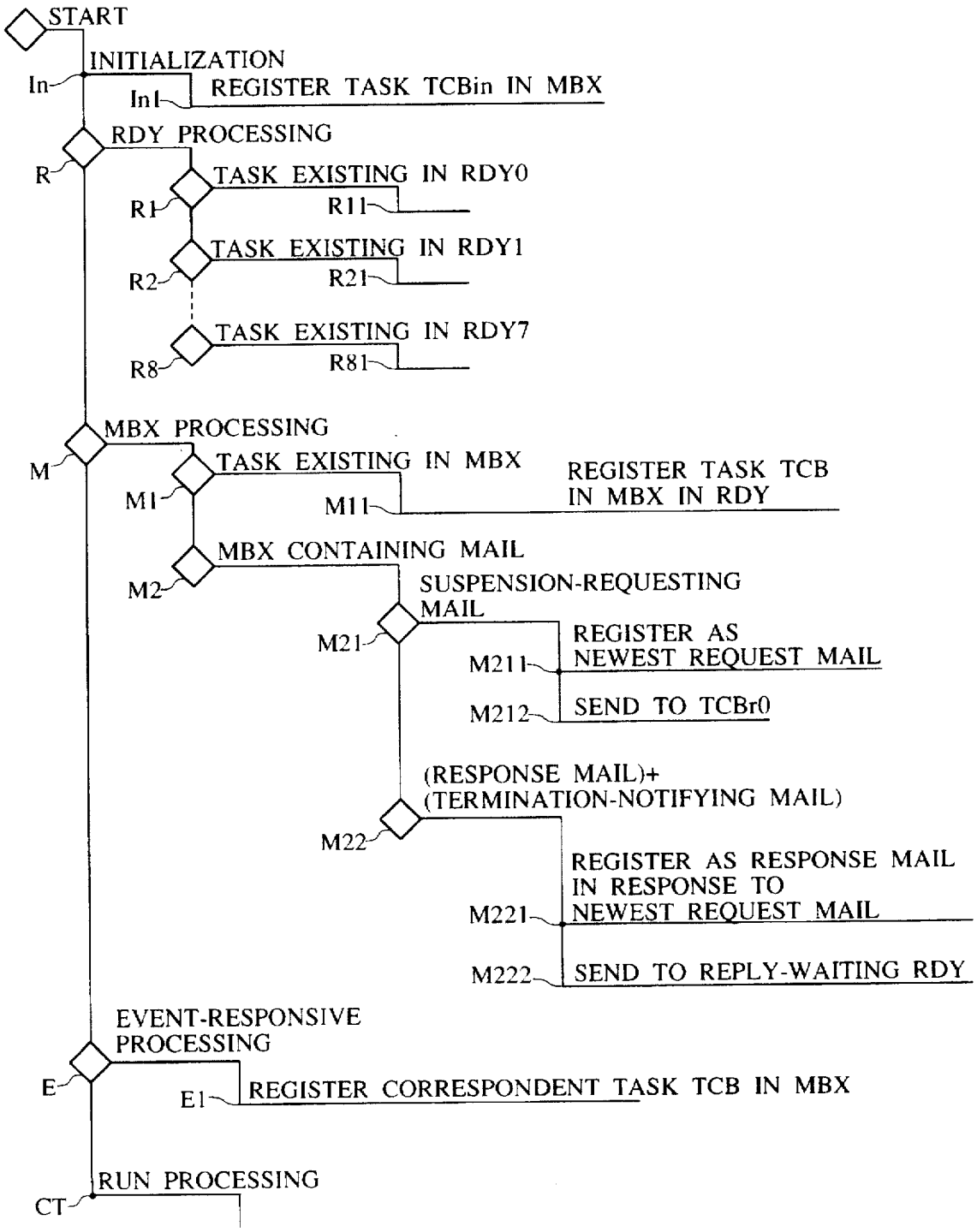
FIG. 14 is a hierarchical operation diagram showing main tasks carried out by the stamp-making apparatus.

In the hierarchical operation diagram, each processing branch point designated by symbol ◇ shows a task, a program, or a subroutine, which is of an event-driven type i.e. executed when an event, such as an interrupt or activation of a task by another task, has occurred. The task-monitoring/switching (RDY) processing shown in FIG. 14 is started only when an interrupt is generated at regular time intervals e.g. through a real time monitoring. Further, the mailbox (MBX) processing is also started by an interrupt generated at regular time intervals other than the regular time intervals of the PDY processing. The event-responsive processing registers various events, such as tasks initiated by operations of the operating dial 23, in the mailbox MBX. Although only one routine is shown in FIG. 14 as a representative, actually, the mailbox MBX is accessed for registration of the name of a task to be executed in response to each event independently whenever the event occurs.

As shown in FIG. 14, when the program is started by turning on the power, first, the initialization at a processing branch point In (hereinafter referred to as "the initialization (In)") is executed. The initialization (In) registers a task TCBin of main tasks-starting processing in the mailbox MBX (In1). When the initialization (In) is terminated, if it is neither time for the RDY processing nor time for the MBX processing, or any other event has not occurred, then the program proceeds to the RUN processing (CT). However, at this time point of the present case, there is no task registered, so that time for starting the RDY processing or the MBX processing is awaited.

In this state, when it becomes time for the RDY processing, the RDY processing (R) is executed, but there are no tasks registered in the priorities RDY0 to RDY7, i.e. no tasks exist in the priorities RDY0 to RDY7 (R1 to R8), so that the RDY processing is terminated without executing any specific processing. On the other hand, when it is time for the MBX processing, the MBX processing (M) is executed, and according to the task TCBin for starting main tasks, which has been registered as TCBm0 in the mailbox MBX, the processing of "task existing in MBX (M1)" is executed to register the task TCB of the mailbox MBX in the priority RDY. That is, if the priority specified for the task TCBin corresponds to the priority RDY4, the task TCBin is registered as TCB40 in the priority RDY4.

Figure 15:
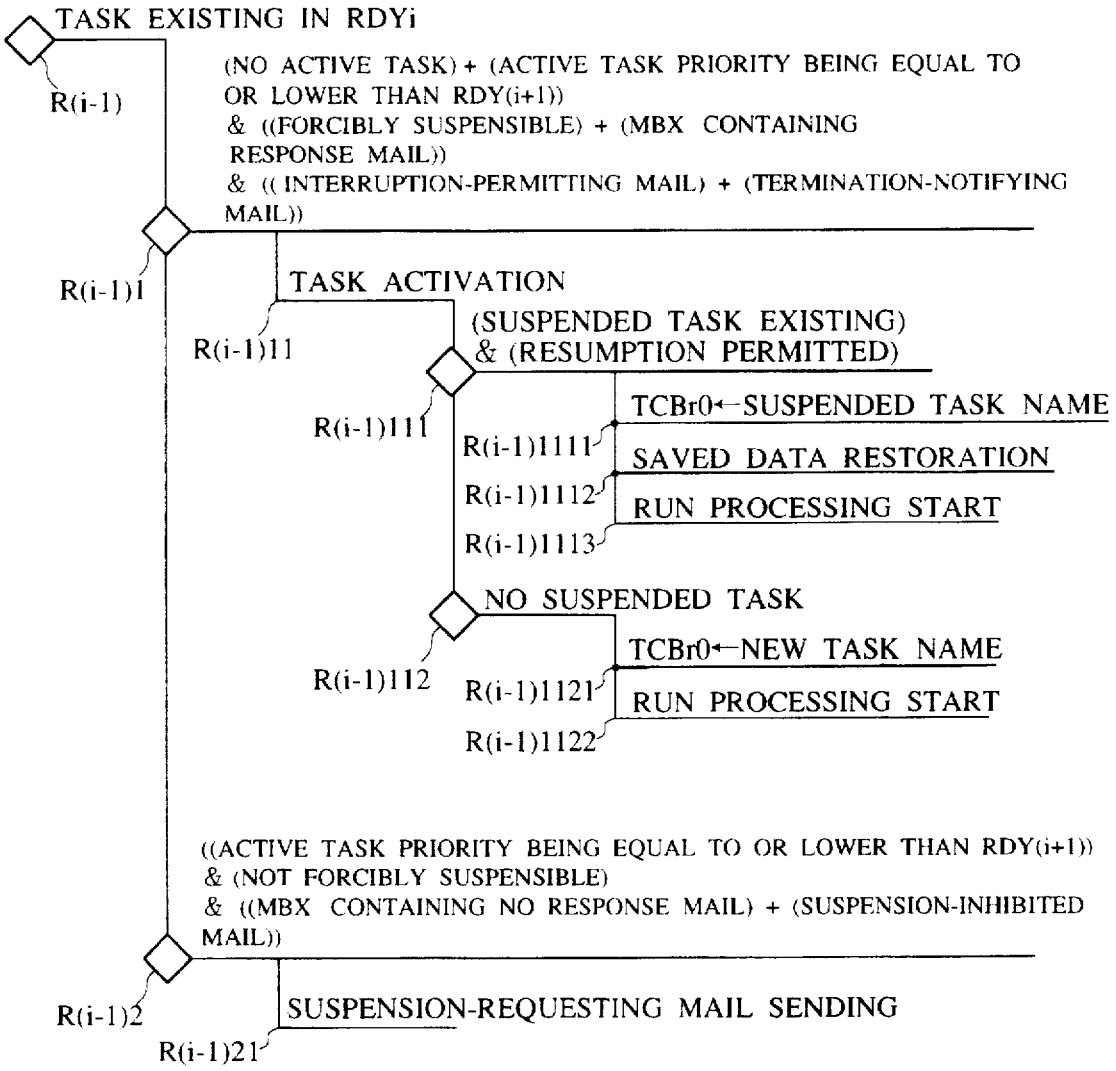
FIG. 15 is a hierarchical operation diagram of task-monitoring/switching processing executed by the stamp-making apparatus.

In this state, when it is time for the RDY processing, the RDY processing (R), e.g. the processing of "task existing in RDY4 (R3)" is executed. Now, the processing of "task existing in RDYi (R(i−1))" will be described with reference to FIG. 15. This processing largely branches into a case of activating a new task (or a suspended task), a case of sending a suspension-requesting mail to the active task, a case of executing no processing.

First, if there is no active task, i.e. if there is no task registered as TCBr0, and hence the RUN processing is not being executed, or if the active task TCBr0 has a priority equal to or lower than the priority RDY(i+1), and at the same time, the active task is suspensible, another task is stated. The term "suspensible" means that the task to be activated can forcibly interrupt execution of the active task, or that a response mail in response to the suspension-requesting mail is an interruption-permitting mail or a termination-notifying mail indicative of termination of the active task. Under the above-mentioned condition, i.e. when the conditions of (no active task)+(active task priority being equal to or lower than RDY(i+1)) & ((forcibly suspensible)+(MBX containing response mail) & ((interruption-permitting mail)+(termination-notifying mail)) are fulfilled at R(i−1)1, the new task starts to be activated at R(i−1)11. Here, "+" represents a logical sum, while "&" a logical product.

On the other hand, a suspension-requesting mail is sent to the mailbox MBX, if the priority of the active task is equal to or lower than RDY(i+1), and at the same time there is no response mail from the active task so that it is not known whether the active task is suspensible or not, or the situation requires resending of the suspension-requesting mail after a response mail saying that the active task is not suspensible was received in response to the preceding suspension-requesting mail. That is, if the conditions of (active task priority being equal to or lower than RDY(i+1) & (not forcibly suspensible) & ((MBX containing no response mail)+(suspension-inhibited mail)) are fulfilled at R(i−1)2, a suspension-requesting mail is sent at R(i−1)21. If neither of the above two sets of conditions are fulfilled, i.e. if the active task priority is equal to or higher than RDYi, no particular processing is executed, but the processing of "task existing in RDYi (R(i−1))" is terminated.

In the task activation (R(i−1)11), if there exists any other task which has been suspended to activate a task higher in priority, or to start a subtask and wait for results of processing by the subtask, it is determined e.g. from resumption information, referred to hereinafter, whether the suspended task can be resumed or not. If the suspended task can be resumed, the processing of (suspended task existing) & (resumption permitted) (R(i−1)111) is executed. In this processing, the suspended task is registered as the active task TCBr0 at R(i−1)111, and if there are any saved data or the like, these data are restored or returned at R(i−1)1112, followed by newly starting the RUN processing at R(i−1)1113. According to generation of this event, task (CT1) is activated in the RUN processing (CT), referred to hereinafter.

When there is no suspended task, the processing of "no suspended task" is executed at R(i−1)112, and after the processing of "TCBr0←new task name" is executed at R(i−1)1112, the RUN processing is started again at R(i−1)1122. For example, when the task TCBin for activating the main tasks is to be executed, in the processing of task activation (R311), the processing of "TCBr0←TCBin (R31121)" is executed in "no suspended task (R3112)", and then the RUN processing is started at R31122.

On the other hand, if there is a suspended task but the resumption of the suspended task is inhibited, the permission of resuming the suspended work has to be awaited, so that the task activation (R(i−1)11) is terminated without executing any processing. It should be noted that since the above-mentioned subtask is normally set to a higher priority than the originating task, generally, the subtask has already been terminated, permitting the originating task to be resumed when the task initiation (R(i−1)11) is processed.

Next, the mailbox (MBX) processing will be described with reference to FIG. 14. In this processing, in the case of "task existing in MBX (M1)", the task TCBm0 in the mailbox MBX is registered at M11 in a priority RDYj according to a priority specified for the task. In the case of "MBX containing mail (M2)", if the mail is a suspension-requesting mail (M21), it is registered as a newest request mail at M211, and sent to the active task TCBr0 at M212, whereas if the mail fulfills the conditions of "(response mail)+(termination-notifying mail)" at M22, it is registered as a response mail in response to the newest request mail (at M221) and sent to a reply-waiting RDY (at M222).

Next, the event-responsive processing (E) will be described. Although the initialization (In) is described as a different kind of processing from this processing for the convenience of explanation, it is actually a kind of event-responsive processing (E). That is, the event-responsive processing (E) registers a task created by an event from the outside of the CPU, such as a manipulation of the operating dial 23, or a task created for execution of a program for internal processing, in the mailbox MBX at E1. For example, after registration in the mailbox MBX, the task TCBin for starting the main tasks is registered in the priority RDY, and then executed as a new task by the (RUN) processing described below.

Figure 16:
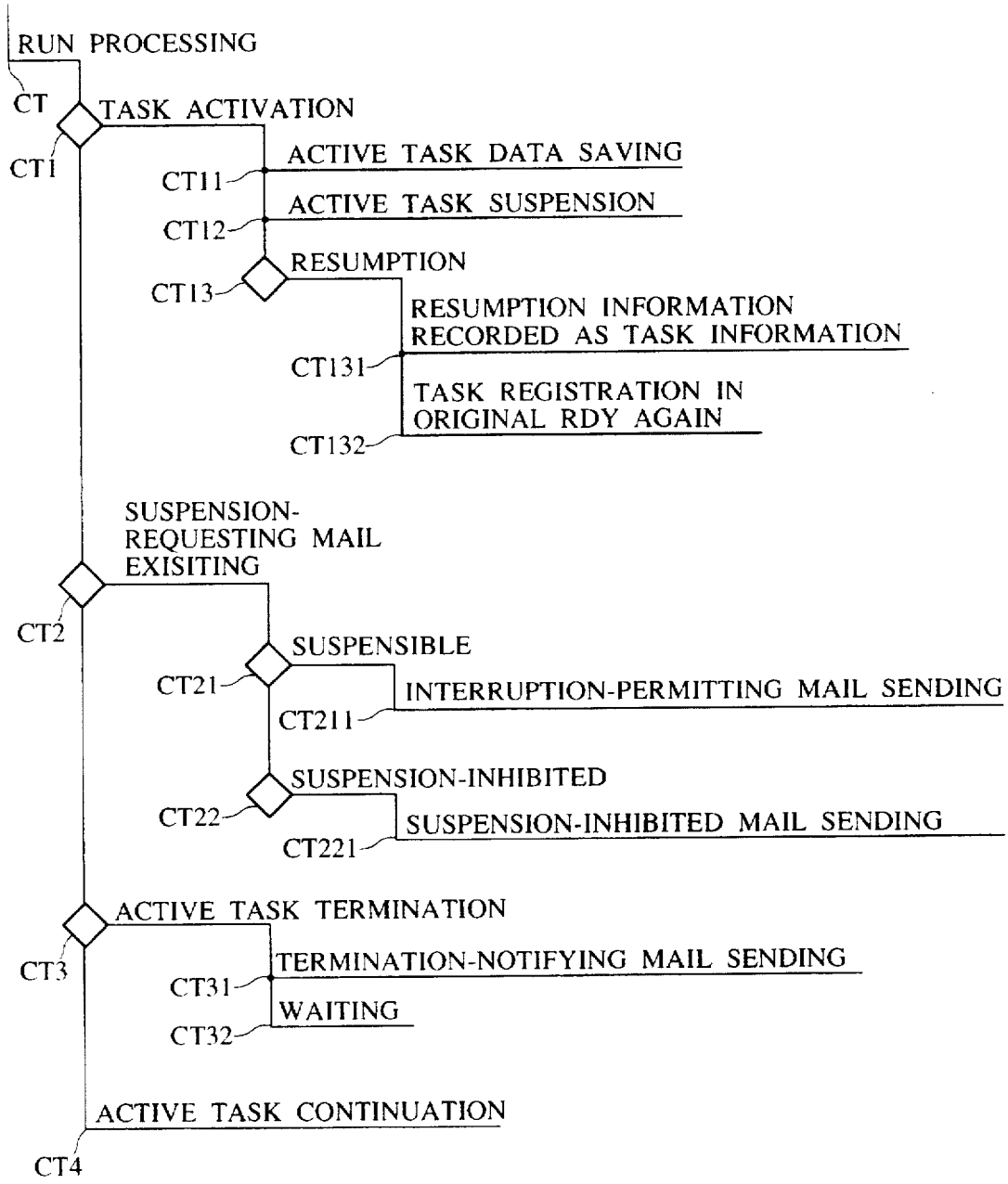
FIG. 16 is a hierarchical operation diagram of active task-executing processing executed by the stamp-making apparatus.

Now, the active task run (RUN) processing (CT) will be described with reference to FIG. 16. This processing continues the active task TCBr0 when there is no other event generated as described above. During this processing, there occur events of "task activation (CT1)", "suspension-requesting mail existing (CT2)" and "active task termination (CT3)". If these events do not occur, the processing of the active task is continued at CT4. If another task is to be activated at CT1, data of the active task being executed is saved at CT11, and then the active task is suspended at CT12. If resumption of the task is expected at CT13, resumption information is recorded as task information at CT131, based on which the task is registered again in the original priority RDY at CT132.

When the suspension-requesting mail existing at CT2, it is determined whether or not the active task is in a suspensible state. If the active task is suspensible at CT21, an interruption-permitting mail is sent to the mailbox MBX at CT211, while if it is not suspensible at CT22, a suspension-inhibited mail is sent at CT221. It should be noted that although similar processing is executed to temporarily suspend the RUN processing, when the RUN processing (CT) being executed is switched to the RDY processing (R), the MBX processing (M) or the event-responsive processing (E), this processing is a basic routine for real-time monitoring which is different from the processing of switching to the other tasks, and hence description thereof is omitted. When the active task TCBr is terminated at CT3, the termination-notifying mail is transmitted to the mailbox at MBX CT31, and the following task activation is awaited at CT32.

Figure 17:
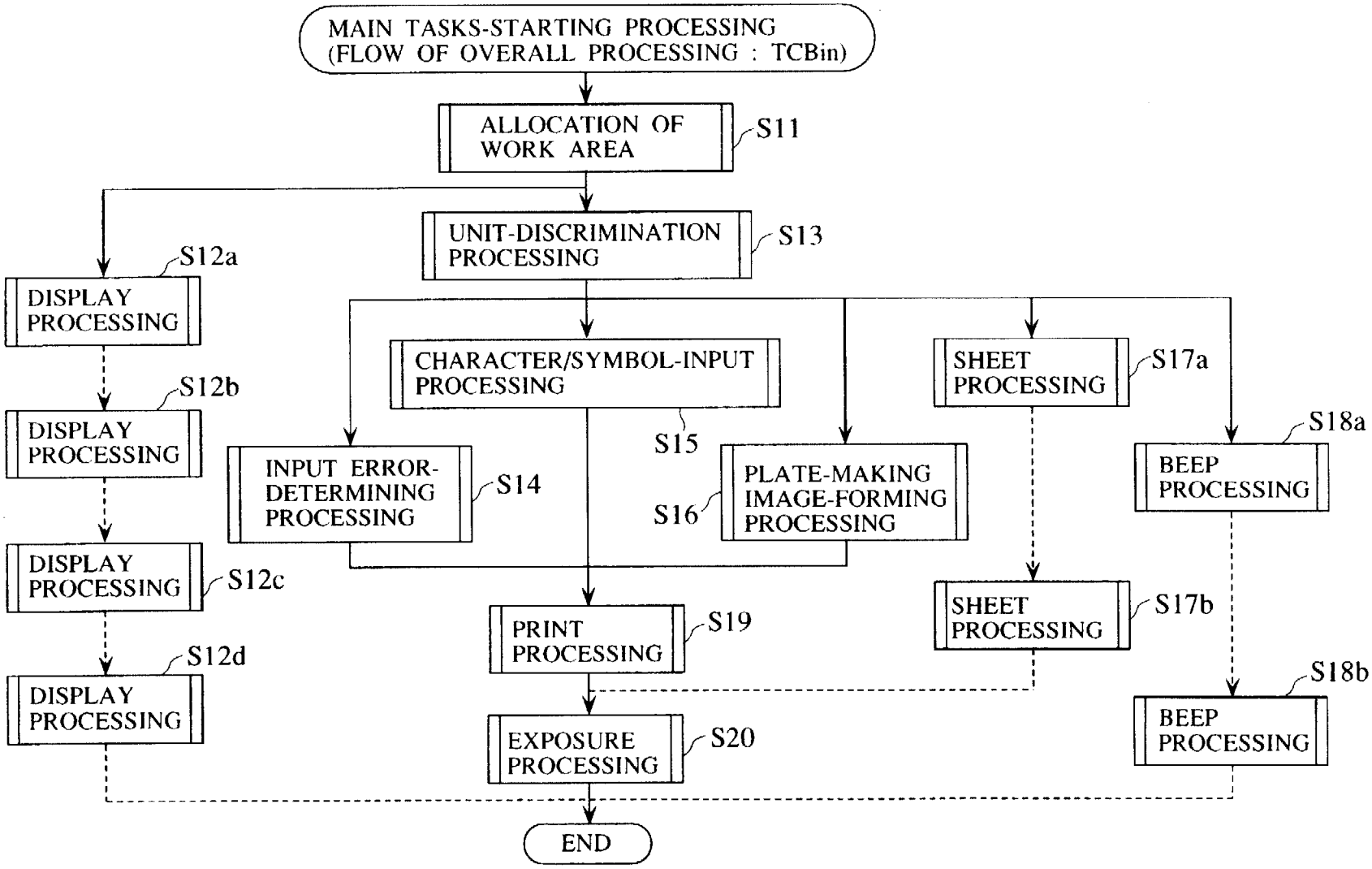
FIG. 17 is a flowchart of an example of main tasks-starting processing executed by the stamp-making apparatus.

FIG. 17 shows an example of the main tasks-starting processing. As shown in the figure, when the main tasks-starting processing task TCBin is activated, first, a task of allocating a work area is registered in the mailbox MBX at a step S11, and then a task of display processing and a task of unit (stamp body)-discriminating processing are registered in the mailbox MBX at respective steps S12 and S13. Then, a task of input error-determining processing is registered at a step S14, a task of character/symbol-input processing at a step S15, a task of plate-making image (stamp image)-forming processing at a step S16, a task of sheet processing at a step S17, and a task of beep processing at a step S18. Then, after a task of print processing is registered at a step S19, a task of exposure processing is registered at a step S20. The MBX processing classifies these tasks, i.e. the subtasks of the main tasks-starting processing task TCBin according to the order of priority and registers each of them in a proper priority RDYj, and then the RDY processing causes them to be activated one after another. Further, after these subtasks are started, subtasks of the subtasks are registered in the mailbox MBX as required and each of them is activated by the RDY processing.

That is, a plurality of tasks including the task TCBin of the initialization continue to be executed until they are each eventually delayed or placed in a wait state. The internal processing of the stamp-making apparatus 1 proceeds to a next step by the multitasking described above when another task as a cause of the wait state of a task has progressed to be deactivated, so that eventually, the internal processing of the multitasking enters a state in which an entry or other operation by the user is awaited. Conversely, once the user operates, the tasks therefor including error handling tasks are sequentially carried out, and eventually the program enters a state in which another operation by the user is awaited.

Therefore, the user actually feels that various processing operations or tasks are executed in parallel and simultaneously. That is, according to the processing of the present stamp-making apparatus 1, compared with a manner of processing in which the processing proceeds to a next step each time only in response to an operation by the user, various kinds of processing operations which will be required to be executed later can be executed in advance, whereby a time period during which the man or user has to wait can be minimized, enabling high-speed processing to be attained. It should be noted that parallel processing, such as the multitasking processing described above, can be realized by forming the program or all the tasks described above by interrupt handlers and employing an interrupt control circuit which controls the order of priority of interrupts generated.

The dotted lines appearing in FIG. 17 show that tasks appear to be simultaneously executed in parallel with each other. Further, the task of character/symbol-input processing (step S15), the task of input error-determining processing (step S14), and the task of plate-making image-forming processing (step S16) are simultaneously executed. More specifically, after a first entry of characters or the like (letters, symbols, figures, or the like) is effected, and before the following entry of characters or the like is effected (step S15), it is determined at the step S14 whether or not there is an inconvenience in the number of characters entered in a text, and an image for use in the plate-making is formed at the step S16. In the course of executing these steps, if another character entry is carried out at the step S15, the task of the input error-determining processing (S14) and that of the plate-making image-forming processing (step S16) are immediately stopped, and then resumed from the start thereof. In the meanwhile, the display processing (step S12, shown as S12*a* to S12*d*) and the beep processing (step S18, shown as S18*a* and S18*b*), further, the sheet processing (step S17, shown as S17*a* and S17*b*) responsive to insertion of the plate-making sheet, are being executed in parallel with the above steps.

The printing apparatus according to the embodiment of the invention incorporated in the stamp-making apparatus 1 is essentially implemented by the control block 300, the stamp-detecting block 66, and the printing block 64. Features of operations executed by the stamp-making apparatus 1 will be described with reference to FIGS. 18 to 25B.

Figure 18:
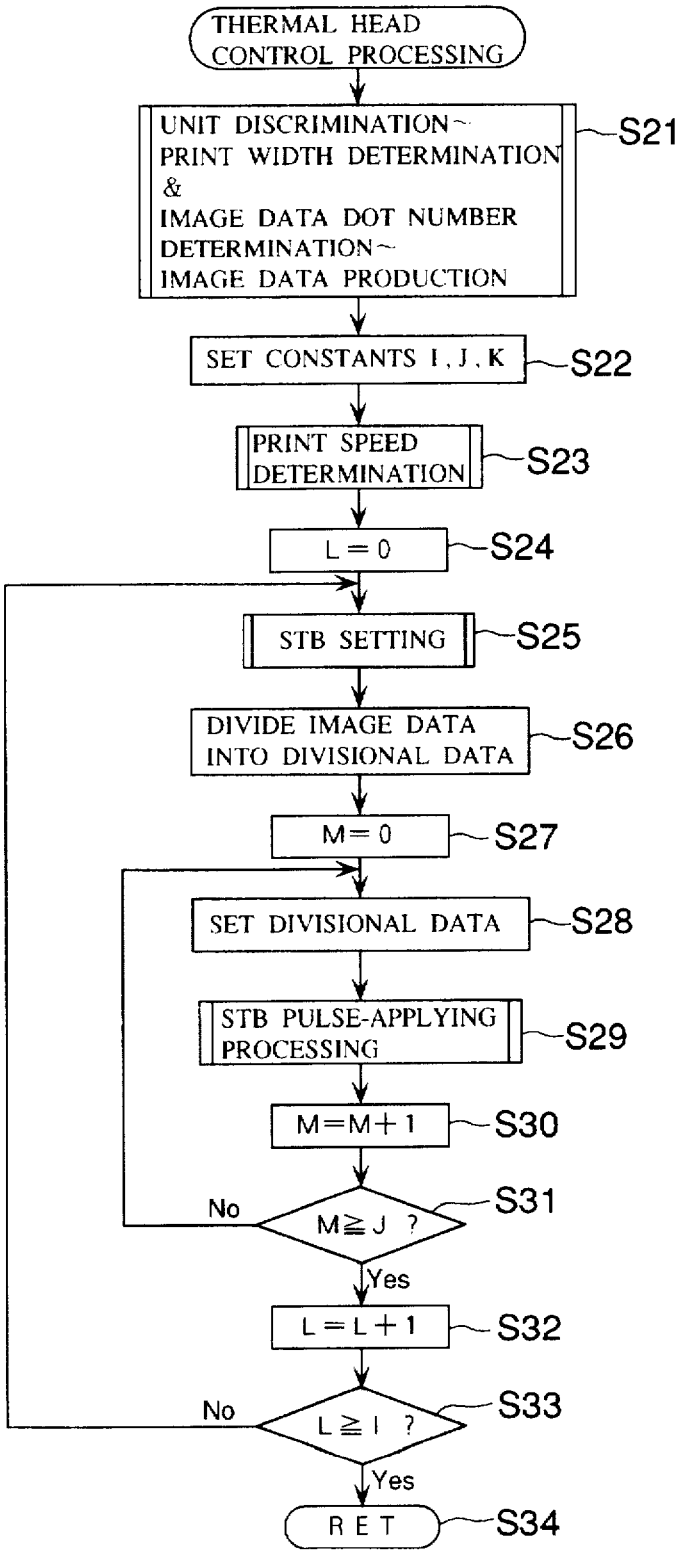
FIG. 18 is a flowchart of thermal head control processing carried out by the printing apparatus according to the embodiment.

As shown in FIG. 18, the printing apparatus carries out thermal head control processing for the stamp-making apparatus 1. This processing is a subtask started at the print processing (S19) in FIG. 17. Since the print processing is started after the input error-determining processing (S14), the character/symbol-input processing (S15) and the plate-making image-forming processing (S16) are terminated, image data is already ready for use when the present processing or subtask is started. Further, actually, the unit discrimination (stamp type discrimination) at a first step (S21) in FIG. 18 has already been executed in the unit-discriminating processing (S13) before the start of the present processing, and print width (width of a print area), referred to hereinafter, has also already been determined therein. Therefore, in the present processing described hereafter, actually, the information obtained by the unit-discriminating processing is only referred to, but this processing is included in the present flow of processing for explanation purposes.

When the thermal head control processing is started, first, at the step S21, the stamp-detecting block 66 discriminates or determines the type of the stamp body A, and based on information obtained thereby, the print width and the number of dots for image data of stamp characters for plate-making are determined, followed by forming the image data for plate-making. Then, based on the image data and the print width, constants I, J and K are determined at a step S22.

The constant I represents the number of transverse lines of dots of the image data. For example, in the case of an image data of 128×128 dots or pixels, the constant I, i.e. the number of transverse lines each formed of 128 dots and orthogonal to the direction of feed of the ink ribbon C, which is counted in this direction, is equal to 128. Further, the constant J represents an image-dividing number, i.e. the number of divisions of the image data divided for printing, referred to hereinafter. Now, the number of dots of image data arranged in a line in a transverse direction is referred to hereinafter as a "one-line dot number". In the present embodiment, for a one-line dot number of 128, J=3 is set, for a one-line dot number of 88 or 64, J=2, and for a one-line dot number of 44, J=1. Further, the constant K represents a strobe-dividing number, i.e. the number of divisions (split pulses), referred to hereinafter, of each strobe pulse applied to the print head (thermal head) 56, and is set such that the temperature of a surface of the thermal head 56 (hereinafter referred to as "the head surface temperature") can be preserved below a predetermined temperature. In the present embodiment, the constant K is uniformly set to five, for all images of any one-line dot number. In practice, the image-dividing number J and the strobe-dividing number K may be set based on the performance of the printing block 64, particularly the thermal head 56, the number of dots of image data, and other control parameters, as well as results of actual printing of image data carried out for adjustment purposes.

Figure 19:
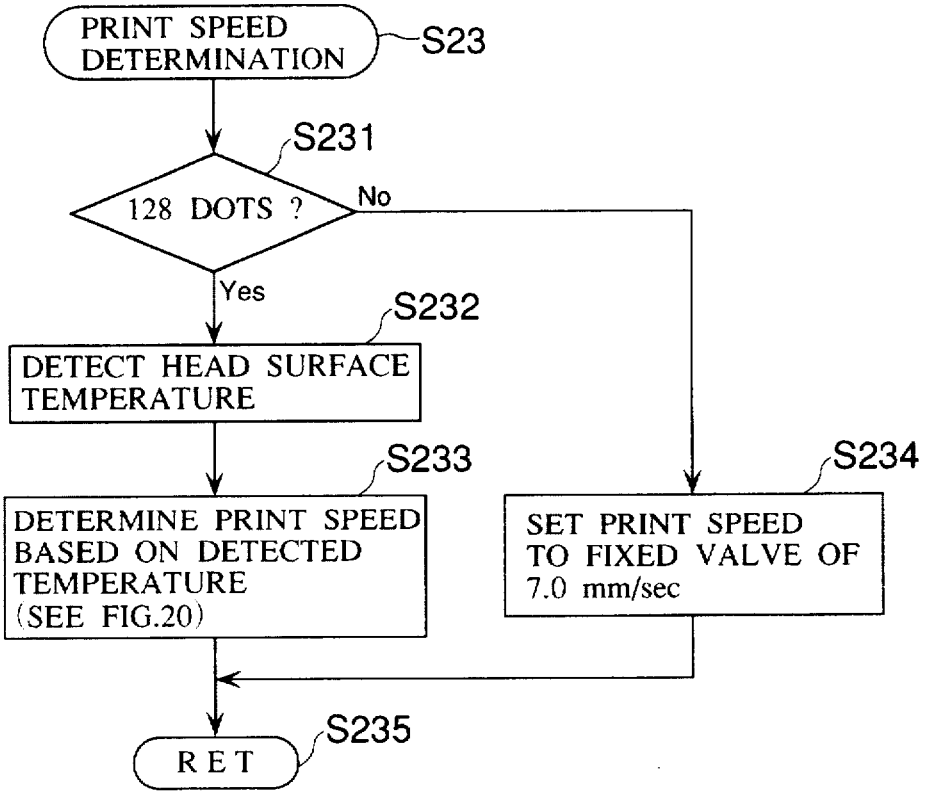
FIG. 19 is a flowchart of print speed-determining processing executed at a step S23 in FIG. 18.

When the constants I, J, and K are determined at the step S22, the print speed is determined at a step S23. Referring to FIG. 19, which shows a subroutine of the print speed-determining processing, first, it is determined at a step S231 whether or not the aforementioned one-line dot number is equal to 128. If the one-line dot number is equal to 128, the head surface temperature sensor 56*b* detects the head surface temperature at a step S232, and the print speed is determined based on the detected head surface temperature at a step S253, whereas if the one-line dot number is not equal to 128, the print speed is set to a fixed value, in the present embodiment, 7.0 mm/sec at a step S234, followed by terminating the processing. FIG. 20 shows the relationship between the detected head surface temperature and the determined print speed. As shown in the figure, the print speed is determined based on the detected head surface temperature, only when the one-line dot number is equal to 128, in other words the print speed is set differently only in this case. For example, when the head surface temperature is within a normal temperature range of 22.5° to 27.5° C. in the case of the one-line dot number being equal to 128, the print speed is set to 7.0 mm/sec similarly to cases where the one-line dot number is equal to values other than 128, whereas when the same is within a range of 7.5° to 12.5° C., the print speed is set to 4.5 mm/sec for the one-line dot number of 128.

In the present embodiment, the constant J is set to three when the one-line dot number is equal to 128. This is to hold the head surface temperature below the predetermined temperature while generating a sufficient quantity of heat for each dot on the thermal head 56 in a concentrated manner in spite of the large number of dots for each line. When the constant J or the number of divisions of data is large, as in the case of the one-line dot number being equal to 128, the number of printing operations is simply J (in this core, there) times as large as the number of printing operations carried out when the constant J is equal to 1 e.g. for image data having the one-line dot number of 44, so that it takes a longer time period to complete the whole printing when the one-line dot number is larger than when it is smaller. Therefore, the print speed i.e. the speed of feed of the ink ribbon C should be slower. Particularly, when the ambient temperature is low or when the quantity of heat stored in the thermal head 56 is small, it is required to carry out printing over a still longer time period.

To comply with these requirements, the stamp-making apparatus 1 varies the print speed depending on the detected head surface temperature as described above. This causes the feed speed of the ink ribbon C to be changed according to the surface temperature of the thermal head 56, so that the quantity of heat received per unit area of the ink ribbon C can be maintained within a predetermined range. For example, if the ambient temperature is so low that a required quantity of heat cannot be readily accumulated when a large number of dots of image are to be printed, the feed speed of the ink ribbon C can be adjusted, i.e. slowed down, to thereby enable ink on the ink ribbon C to be attached to the plate-making sheet B with a sufficient adhesion. In the present embodiment, the print speed is made variable only when the one-line dot number is equal to 128, but it goes without saying that the variable print speed can also be applied to other settings of the one-line dot number. In such a case, similarly to the setting of the image-dividing number J, the print speed may be set based on various control parameters while taking results of actual printing into consideration.

By the adjustment of the print speed and the division of image data, it is possible to cause the thermal head 56 to generate heat such that it is intensively applied to print the dots of each division of the image data to thereby transfer ink on the ink ribbon C to the plate-making sheet B with a sufficient adhesion, while holding the head surface temperature below the predetermined temperature, as will be described in further detail hereinafter. This enables ink forming a positive image of an image to be printed to be attached to the plate-making sheet B with a sufficient adhesion, and at the same time a negative image of the same to be formed on the ribbon tape of the ink ribbon C through sufficient separation of the ink therefrom. The negative image is used as a mask in the exposure processing (S20) in FIG. 17 to form a clear and distinct stamp image on a stamp area (stamp surface) of the stamp body A.

Referring again to FIG. 18, when the print speed is determined at the step S23, a variable L is set to an initial value, i.e. L=0 is set, at a step S24. The variable L is associated with the aforementioned constant I representative of the number of transverse lines of dots of the image data. The variable L is used in the present thermal head control processing for repeatedly forming a processing loop for carrying out the printing of a transverse line of dots up to as many times as the constant I (e.g. 128 for 128 dots), by executing a step S32 of incrementing (L=L+1) and a step S33 of determining whether L≧I holds.

Figure 21:
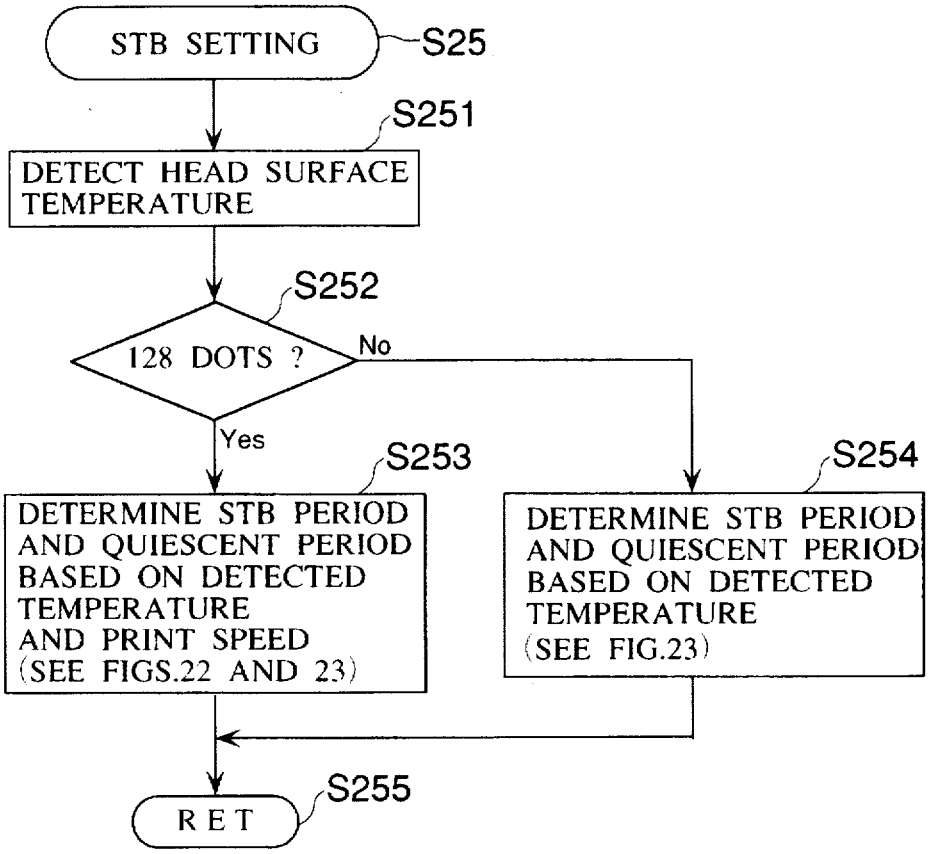
FIG. 21 is a flowchart of strobe (STB)-setting processing executed at a step S25 in FIG. 18.

When the initialization of the variable L (L=0) is effected at the step S24, then strobe (STB)-setting processing is carried out at a step S25. Referring to FIG. 21, in the strobe-setting processing, the head surface temperature is detected at a step S251 similarly to the FIG. 19 processing. Then, it is determined at a step S252 whether or not the one-line dot number is equal to 128. If the one-line dot number is equal to 128, a strobe period over which the strobe pulse is intermittently or continuously applied and a quiescent period during which the strobe pulse is made inactive are determined based on the detected head surface temperature and the print speed at a step S253, whereas if the one-line dot number is not equal to 128, the strobe period and the quiescent period are determined based on the detected head surface temperature at a step S254, followed by terminating this processing.

Figures 23A, 23B:
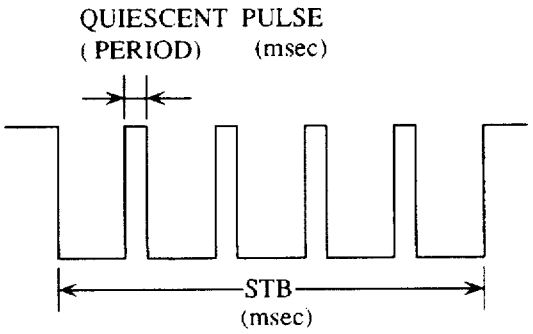
FIG. 23A shows a table of an example of settings of the strobe period and the quiescent period of the strobe pulse, which correspond to the ranges of detected values of the thermal head surface temperature.
FIG. 23B is a diagram showing the relationship between a strobe period and quiescent periods of the strobe pulse divided into five split pulses.

The above processing is not essentially different between when the one-line dot number is equal to 128, and when the same is not equal to 128. In the case of the one-line dot number being equal to 128, the print speed depends on the detected head surface temperature, so that the strobe period and the quiescent period are determined from the detected head surface temperature and the print speed, whereas in the case of the one-line dot number being equal to a smaller number, the print speed is set to a fixed value irrespective of the detected head surface temperature, so that the above time periods can be determined based on the detected head surface temperature alone. When the example of settings of the strobe period and the quiescent period both set for each print speed in the case of the one-line dot number being equal to 128, shown in FIG. 22, and the example of settings of print speeds, shown in FIG. 20, and described hereinbefore with reference thereto are combined, there result the settings shown in a column for the one-line dot number of 128 appearing in FIG. 23A. For example, when the detected head surface temperature is equal to or lower than 7.5° C., the print speed is set to 4.0 mm/sec (see FIG. 20). When the detected head surface temperature is equal to or lower than 7.5° C., and at the same time the print speed is equal to 4.0 mm/sec, the strobe period and the quiescent period (quiescent pulse) are set to 5.00 msec. and 0.000 msec, respectively (see FIG. 22). When the detected head surface temperature is within a normal temperature range of 22.5° to 27.5° C., the print speed is set to 7.0 mm/sec (see FIG. 20), and hence the strobe period and the quiescent period are set to 3.40 msec. and 0.200 msec, respectively (see FIG. 22). These values are shown in FIG. 23A in the column of the one-line dot number of 128 at respective rows of a detected head surface temperature range of 7.5° C. or lower temperatures and a detected head surface temperature range of 22.5° to 27.5° C. Now, the strobe period and the quiescent period will be described with reference to FIGS. 23A and 23B.

As shown in FIGS. 23A and 23B, in the stamp-making apparatus 1, a time period (split pulse-applying period) over which each of the five split pulses of the strobe pulse divided according to the strobe-dividing number K=5, referred to hereinabove, is applied to the thermal head 56 and a quiescent period between two consecutive split pulses are set in a manner corresponding to the number of dots of the image data. STB in FIG. 23A represents the strobe period, (overall strobe pulse-applying period including quiescent periods) over which one whole strobe pulse is applied, and the quiescent pulse means the quiescent period during which the strobe pulse is not active. In FIG. 23B, the upper-side level of the waveform of the strobe pulse indicates a ground potential level (e.g. 0 V), and the lower-side level of the same an active or energized level (e.g. 5 V).

For example, when the temperature is within the normal range of 22.5° to 27.5° C., and the one-line dot number is equal to 128, the strobe (STB) period is set to 3.40 msec. and the quiescent pulse to 0.200 msec. Since the strobe-dividing number K is equal to five, a split pulse-applying period (pulse duration) over which one split pulse is applied can be calculated by the equations of (STB+quiescent pulse)/K=(3.40+0.20)/5=0.72 msec; 0.72 msec.−0.20 msec.=0.52 msec. That is, a split pulse is applied over a time period of 0.52 msec, and with intermission of a quiescent period of 0.20 msec, each of the following four split pulse is similarly applied. Thus, a total of five split pulses of the strobe pulse are applied (see FIG. 25B). The sum or cumulative period of five split pulse-applying periods is equal to 0.52×5=2.60 msec. In the case where the detected head surface temperature is in the same range but the one-line dot number is equal to 64, similarly, a split pulse is applied over a time period of 0.44 msec, and with intermission of a quiescent period of 0.125 msec, each of the following four split pulses is similarly applied over the same time period of 0.44 msec, resulting in a cumulative period of 2.20 msec. These values are set through adjustments based on results of actual printing such that the plate-making sheet as the printing object is printed with ink with a sufficient adhesion, and that heat is prevented from being wastefully applied in an excessive amount.

As stated hereinbefore in describing the first step (S21) in FIG. 18, the print width and the number of dots of the image data are determined in a manner corresponding to the type of the stamp body A detected by the stamp-detecting block 66. In general, the number of dots required for clear print of an image is different between when an image is printed on a broad print area and when an image is printed on a narrow print area. Further, a time period required for the clear print of the image, i.e. a time period required for the pulse to be active for obtaining a required quantity of heat varies with the number of dots of the image data. In the stamp-making apparatus 1 to which the printing apparatus of the present invention is applied, depending on the type of each stamp body, the required print width is determined based on the size and shape of a stamp surface of the stamp body A, and the necessary and sufficient number of dots for clear print of the image is determined according to the print width. Based on the determined number of dots and the head surface temperature detected by the head surface temperature sensor 56*b*, the strobe (STB) period, and the quiescent period can be set to respective values suitable for obtaining a required quantity of heat as shown in FIG. 23A.

Further, in the stamp-making apparatus 1, as shown in FIG. 23A, when the detected head surface temperature is lower than a predetermined value, e.g. when the same is below 22.5° C. for the one-line dot number of 128, or when the same is below 7.5° C. for a smaller one-line dot number, the quiescent period is set to zero. In general, when the detected head surface temperature is lower than a certain value, e.g. when the thermal head 56 is newly driven for printing or when the ambient temperature is low, there can hardly occur an excessive rise in the head surface temperature and thermal deformations caused thereby, such as wrinkles, but rather, the important problem is how to obtain a sufficient quantity of heat in a short time period. In such a case, according to the present embodiment, the quiescent period is set to zero to join the split pulses into a continuous pulse to thereby enable the sufficient quantity of heat to be obtained in a short time period similarly to the case of a conventional strobe pulse continuously applied as a unit.

Referring again to FIG. 18, when the strobe-setting processing (S25) is completed, then, divisional image data is produced at a step S26. That is, data of a transverse line of dots corresponding to the variable L, e.g. data of a first line or No. 1 (=L+1) line when L=0, is divided according to the image-dividing number J. For example, in the case of the image data having the one-line dot number of 128, divisional data 1 is constituted by data of (J×i+1)-th dots (i=0, 1, 2, . . . , n; n is equal to 128/J=128/3→42), i.e. a first dot, a fourth dot, a seventh dot, . . . , a 124-th dot, and a 127-th dot. Similarly, divisional data 2 is formed by data of J×i+2)-th dots), i.e. a second dot, a fifth dot, an eighth dot, . . . . a 125-th dot, and a 128-th dot, and divisional data 3 is formed by data of J×i+3)-th dots), i.e. a third dot, a sixth dot, a ninth dot, . . . , and a 126-th dot (in the present case, n=41). In the case of image data of the one-line dot number of 64, divisional data 1 is formed by data of a first dot, a third dot, a fifth dot, . . . , and a 63rd dot, and divisional data 2 by data of a second dot, a fourth dot, a sixth dot, . . . , and a 64th dot. The image data can be easily divided by forming masks each formed by image data in which dots other than component dots forming specific divisional data are made void or ineffective, and carrying out arithmetic operations to obtain the product of the image data and a corresponding one of the masks. The divisional data is used in strobe pulse-applying processing, described hereinafter with reference to FIG. 25A.

When the image data is divided at the step S26, the variable M is set to an initial value, i.e. M=0 is set at a step S27. This variable M corresponds to the aforementioned image-dividing number J. The variable M is used in the present thermal head control processing for repeatedly forming a processing loop for carrying out the printing up to as many times as the image-dividing number J (e.g. three for the one-line dot number of 128), by executing a step S30 of incrementing (M=M+1) and a step S31 of determining whether M≧J holds.

When the initialization of the variable M at the step S27 is terminated, divisional image data is set at the step S28, and the strobe pulse is applied at the step S29. Then, the step S30 is carried out for incrementing the variable M, i.e. M=M+1 is set, and then if M<J holds at the step S31, the step S28 to the step S30 are repeatedly carried. If M≧J holds at the step S31, the program proceeds to the step S32 to increment the variable J, i.e. J=J+1 is set. If L<I holds at the step S33, the step S25 to the step S32 are repeatedly carried out until L≧I holds at the step S33, whereupon the thermal head control processing is terminated at a step S34. For example, when the one-line dot number is equal to 128, I=128 and J=3 are set, so that during each repeated execution of the step S25 for setting the strobe to the step S32 for effecting the incrementing of L=L+1, 128 times, the step S28 for setting divisional data to the step S30 for effecting the incrementing of M=M+1 are executed repeatedly i.e. three times. When the one-line dot number is equal to 64, I=64 and J=2 are set, so that the number of repeated executions of the steps S25 to S32 is equal to 64, and the number of repeated executions of the steps S28 to S30 is equal to 2.

Now, operations carried out during the above loops will be described with reference to FIGS. 18, 24 and 25A. The following description will be made of an example in which image data has the one-line dot number of 128. However, the operations are basically the same for image data having other one-line dot numbers. As shown in FIG. 25A, as the platen roller 57 is rotated to a degree corresponding to one transverse line of dots of image data for printing, three line trigger pulses LP1, LP2 and LP3 are sequentially generated in a manner linked to the control of the motor-driving circuit 57*a* (see FIG. 11), to request respective printing operations, whereby the printing operations are controlled in a manner timed to these pulses LP1, LP2 and LP3. First, before the timing of generation of the line trigger pulse LP1, the head surface temperature is detected (see FIG. 21) and the strobe setting is effected (S25). Then, at the timing of generation of the line trigger pulse LP1, the divisional data 1 produced at the step S26 is set as data to be transferred to the head drive circuit 56*a* (S28), and the strobe (STB) pulse-applying processing (S29) is started.

Figure 24:
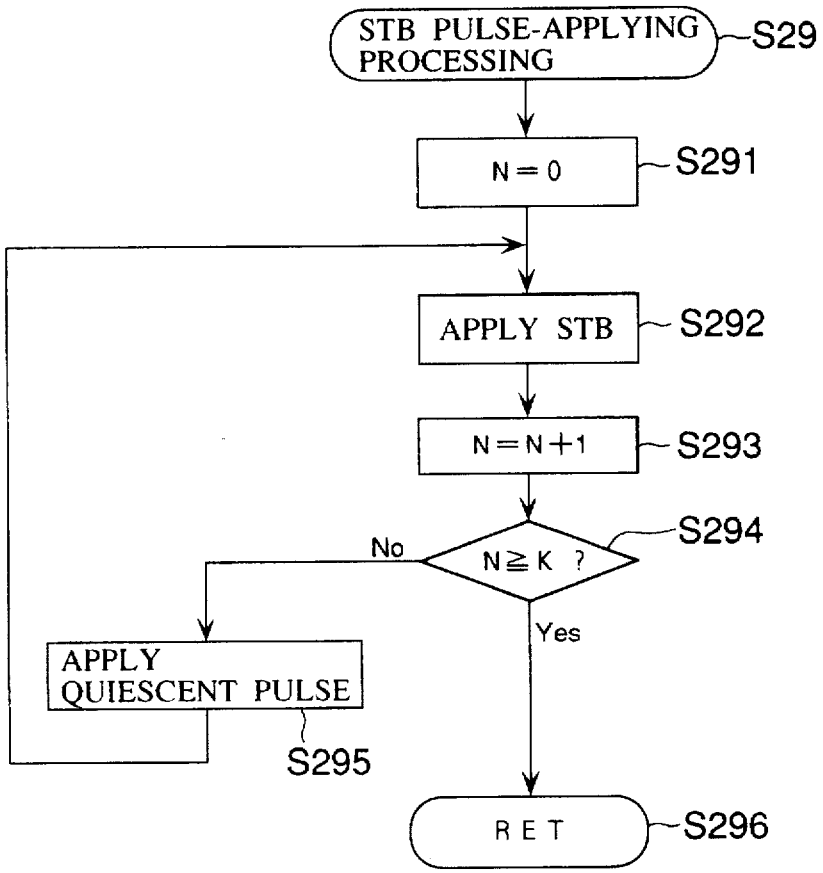
FIG. 24 is a flowchart of strobe (STB) pulse-applying processing executed at a step S29 in FIG. 18.
Figures 25A, 25B:
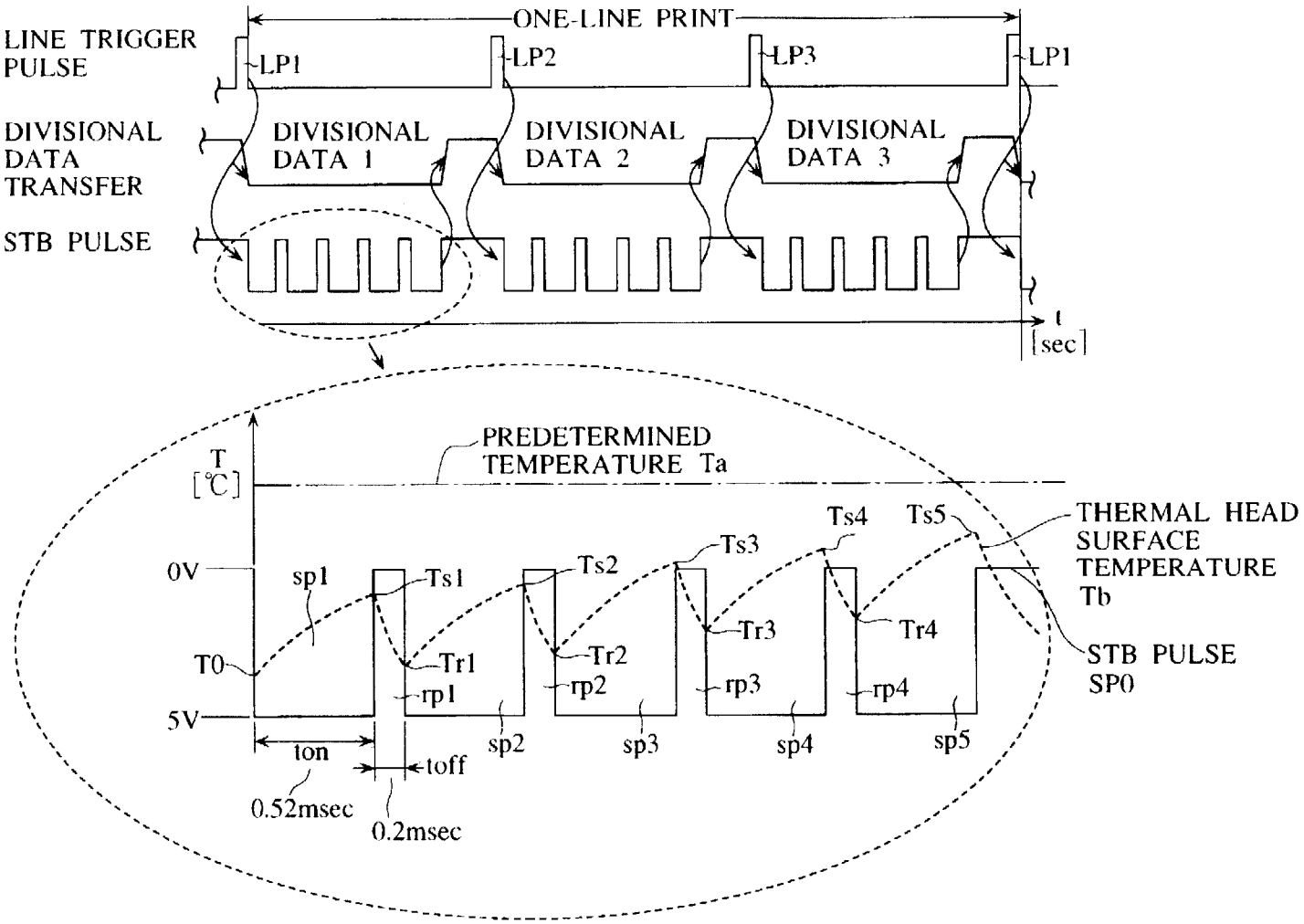
FIG. 25A is a timing chart showing the relationship between line trigger pulses, divisional data for transfer, and strobe pulses, which are used or processed in the FIG. 18 thermal head control processing.
FIG. 25B is a timing chart showing the relationship between the strobe pulse and the thermal head surface temperature.

Referring to FIG. 24, in the strobe (STB) pulse-applying processing (S29), first, a variable N is initialized, i.e. N=0 is set at a step S291. The variable N is associated with the aforementioned strobe-dividing number K. Then, a strobe is made active i.e. a split pulse of a strobe pulse is applied at a step S292, and the incrementing of N=N+1 is effected at a step S293. If N<K holds at the following step S294, a quiescent pulse is generated, i.e. the strobe is made inactive over a quiescent period at a step S295. After the steps S295 to S293 are repeatedly carried out for generation of a quiescent pulse, application of a split pulse, and effecting the increment of N=N+1, if N≧K holds at the step S294, the present processing is terminated. As described hereinbefore, in the present case, the strobe-dividing number K is equal to 5, so that five split pulses (S292), and four quiescent pulses (S295) are applied before termination of the STB pulse-applying processing.

The split pulses sp1 to sp5 (S292) and the four quiescent pulses rp1 to rp4 (S295) are generated alternately as shown in FIG. 25B, and the width of each of the split pulses, i.e. a pulse duration (split pulse-applying period) ton, and that of each of the quiescent pulses, i.e. a quiescent period toff, are set to respective corresponding values shown in FIG. 23A. For example, when the one-line dot number is equal to 128 and the detected head surface temperature is within a range of 22.5° to 27.5° C., the pulse duration ton is equal to 0.25 msec. and the quiescent period toff 0.20 msec.

As shown in FIGS. 18 and 25A, in response to the first line trigger pulse LP1, the setting of the first divisional data 1 (S28) and the application of the first five split pulses sp1 to sp5 (S29) are executed, whereby a portion of ink on the ink ribbon C for the divisional data 1 is transferred to the plate-making sheet B. After termination of this process at a finial trailing edge of the split pulse sp5, the following line trigger pulse LP2 is awaited. Then, the line trigger pulse LP2 is generated, in response to which the divisional data 2 is set at the step S28, and the five split pulses sp1 to sp5 are applied at the step S29 to transfer a portion of ink for the divisional data 2 to the plate-making sheet. Similarly, in response to the line trigger pulse generated thereafter, a portion of ink for the divisional data 3 is transferred to the plate-making sheet to thereby complete transfer of ink for the first-line portion of the image data, i.e. printing of dots on the first transverse line of dots of image data.

When the printing of the first transverse line of dots of the image data is completed, the processing from the head surface temperature detection to the strobe setting (S25) are carried out again before the timing of generation of another first line trigger pulse LP1, and then the first line trigger pulse LP1 is generated to effect transfer of the divisional data 1. Similarly, in response to a second line trigger pulse LP2 generated thereafter, the transfer of divisional data 2 is carried out, and in response to the following third line trigger pulse LP3, the transfer of divisional data 3 is carried out, followed by terminating transfer of ink for dots on a second transverse line. Dots on the third to 128-th lines are printed similarly to thereby complete the printing of the whole data of an image.

Next, the relationship between the split pulses and the thermal head surface temperature will be described with reference to FIGS. 25A and 25B. As shown in FIG. 25B, through application of a first one sp1 of five split pulses sp1 to sp5 of a strobe pulse SP0 indicated by the solid lines, the head surface temperature Tb rises during a pulse duration ton from an initial detected value TO to an after-pulse value Ts1 reached after application of the first split pulse, as shown by the dotted lines in FIG. 25B. Thereafter, during a quiescent period toff, there occurs a sudden drop of the temperature to an after-quiescent value Tr1 reached upon termination of the quiescent state. Similarly, through application of the second split pulse sp2, the temperature rises to a value Ts2, and thereafter drops to a value Tr2 during the following quiescent period.

Similarly, although the temperature rises to after-pulse values Ts3 and Ts4 through application of the split pulses sp3 and sp4, it also drops to after-quiescent values Tr3 and Tr4 during respective quiescent periods, so that even after the fifth split pulse sp5 of the strobe pulse SP0 is finally applied, the head surface temperature assumes an after-pulse value Ts5 below a predetermined temperature level Ta indicated by the one-dot chain line. Conversely, the values of settings shown in FIG. 23A are set based on the performance of the printing block 64, particularly the thermal head 56, and the number of dots of image data, and various control parameters, as well as results of actual printing, such that a rise in the thermal head temperature caused by application of strobe pulses is held below the predetermined value Ta. More specifically, the values of the settings are set such that the head surface temperature after application of the pulses is below a melting point of the ribbon tape of the ink ribbon C.

From the theory of operations, the head surface temperature Tb naturally varies between when the printing apparatus is newly driven for printing and immediately after it has been driven for printing. Further, the head surface temperature Tb depends on the ambient temperature. A quantity of heat newly required for attaching ink on the ink ribbon C to the plate-making sheet B with a sufficient adhesion varies with the head surface temperature Tb before starting the printing, i.e. the quantity of heat accumulated on the thermal head 56 before starting the print. In the present embodiment, the head surface temperature Tb is detected, and based on results of the detection, a time period over which the strobe pulse SP0 is applied is determined, whereby it is possible to generate heat only in an amount newly required to be generated on the thermal head 56.

Further, by dividing the strobe pulse SP0 into a plurality of split pulses sp1 to sp5, a strobe period required in obtaining a required quantity of heat is divided into a plurality of split pulse-applying periods (pulse durations) whereby the printing is effected through application of each split pulse a plurality of times. So long as the sum or cumulative period of split pulse-applying periods is sufficient for a required pulse-applying period, the strobe-dividing number K as well as the split pulse-applying period ton of each of the split pulses sp1 to sp5 and the quiescent period can be changed. Further, the split pulse-applying periods ton of the split pulses sp1 to sp5 can be made different from each other, and this also applies to the quiescent periods toff between adjacent ones of the split pulses. For example, the split pulse-applying period (pulse duration) of the split pulse sp2 can be made shorter than that of the split pulse sp1, and the quiescent period rp2 can be made longer than the quiescent period rp1.

In the case of the split pulses sp1 to sp5 shown in FIG. 25B, the adhesion of the ink transferred from the ink ribbon C to the plate-making sheet B is proportional to the product of the pulse voltage and the strobe period. Even if the application of the strobe pulse is carried out in a divided or intermittent manner, the control of the sum of the (split) pulse-applying periods prevents the adhesion of the ink to the plate-making sheet C from being degraded. On the other hand, the head surface temperature Tb drops suddenly or drastically during each quiescent period toff between adjacent ones of the split pulse-applying periods ton, whereby an excessive rise in the head surface temperature Tb can be prevented (by insertion of each quiescent period toff) to hold the head surface temperature Tb below the predetermined temperature Ta. In short, by controlling at least one of the strobe-dividing number K, each split pulse-applying period ton, and each quiescent period toff, it is possible to apply a required quantity of heat to the ink ribbon C depending on the environment of the thermal head 56. Therefore, the plate-making sheet B can be printed with ink with a sufficient adhesion, while preventing heat from being wastefully generated.

Further, by setting the predetermined temperature Ta, specifically, to a temperature at least below a melting point of material of the ribbon tape of the ink ribbon C, the head surface temperature Tb is prevented from rising above the melting point of material of the ribbon tape, whereby it is possible to prevent the ink ribbon C from being irreversibly deformed due to an excessive rise in the temperature of the ink ribbon C. As a result, the negative image formed on the ink ribbon C, which provides masking information, can be preserved in a favorable condition, which enables a clear and distinct stamp image to be formed on the stamp-forming portion of the stamp body A.

Therefore, the method of making a mask pattern by the use of the printing apparatus incorporated in the stamp-making apparatus 1 is capable of forming a mask (mask pattern for exposure) on the ink ribbon, which is formed of a suitable negative image free from thermal deformations, by thermally transferring ink on the ink ribbon C comprised of a transparent ribbon tape as a base material to the plate-making sheet B as the printing object.

Although in the present embodiment, the mask pattern for exposure which is formed on the ink ribbon C is for use in making a stamp, this is not limitative but it may be employed for any use in which the exposure is required in processing or machining, e.g. for processing printed circuit boards. Further, although in the present embodiment, the stamp-making apparatus 1 has the exposure block incorporated therein, this is not limitative, but the printing apparatus may be constructed such that the ink ribbon formed with a mask pattern can be taken out for exposure by various exposure devices, thereby enabling the printing apparatus to be used for general purposes.

It is further understood by those skilled in the art that the foregoing is a preferred embodiment of the invention, and that various changes and modification may be made without departing from the spirit and scope thereof.

What is claimed is:

1. A printing apparatus having a thermal head, said printing apparatus applying a strobe pulse at a predetermined voltage to said thermal head based on information of dots of an image to be printed, to thereby heat said thermal head, and applying heat by said thermal head to an ink ribbon in an amount enabling thermal transfer of ink on said ink ribbon, said printing apparatus comprising:

temperature-detecting means for detecting a temperature of said thermal head;

split pulse-applying means for sequentially applying a plurality of split pulses obtained by dividing said strobe pulse, with quiescent periods respectively interposed between said plurality of split pulses;

pulse-applying data-storing means for storing pulse-applying data of settings of a cumulative period of split pulse-applying periods over which said plurality of split pulses are respectively applied, a number of said split pulses, said split pulse-applying periods, and said quiescent periods respectively interposed between said plurality of split pulses, which are defined in a manner corresponding to values of said temperature of said thermal head; and control means for reading out appropriate pulse-applying data from said pulse-applying data-storing means according to said temperature of said thermal head detected by said temperature-detecting means, and controlling operation of said split pulse-applying means according to said appropriate pulse-applying data.

2. A printing apparatus according to claim 1, wherein said pulse-applying data is defined in a manner such that said temperature of said thermal head in a heated state is below a predetermined value.

3. A printing apparatus according to claim 2, including ribbon feed means for feeding said ink ribbon, and wherein said pulse-applying data includes data of values of a feed speed of said ink ribbon defined according to said values of said temperature of said thermal head, said control means controlling said ribbon feed means in a manner such that said feed speed of said ink ribbon is changed in response to said temperature of said thermal head detected by said temperature-detecting means, according to said data of said values of said feed speed of said ink ribbon.

4. A printing apparatus according to claim 3, wherein said predetermined temperature is a melting point of a material of a ribbon tape of said ink ribbon.

5. A printing apparatus according to claim 3, wherein said control means sets each of said quiescent periods to zero when said temperature of said thermal head detected by said temperature-detecting means is below a certain temperature lower than said predetermined temperature.

6. A printing apparatus according to claim 2, wherein said control means sets each of said quiescent periods to zero when said temperature of said thermal head detected by said temperature-detecting means is below a certain temperature lower than said predetermined temperature.

7. A printing apparatus according to claim 2, wherein said predetermined temperature is a melting point of a material of a ribbon tape of said ink ribbon.

8. A printing apparatus according to claim 7, wherein said control means sets each of said quiescent periods to zero when said temperature of said thermal head detected by said temperature-detecting means is below a certain temperature lower than said predetermined temperature.

9. A printing apparatus having a thermal head, said printing apparatus applying a strobe pulse at a predetermined voltage to said thermal head based on information of dots of an image to be printed, to thereby heat said thermal head, and applying heat by said thermal head to an ink ribbon in an amount enabling thermal transfer of ink on said ink ribbon, said printing apparatus comprising:

temperature-detecting means for detecting a temperature of said thermal head;

split pulse-applying means for sequentially applying a plurality of split pulses obtained by dividing said strobe pulse, with quiescent periods respectively interposed between said plurality of split pulses; and control means for determining a time period over which said strobe pulse is required to be applied based on said temperature of said thermal head detected by said temperature-detecting means, and controlling operation of said split pulse-applying means in a manner such that a cumulative period of split pulse-applying periods over which said plurality of split pulses are respectively applied is sufficient for said time period over which said strobe pulse is required to be applied.

10. A printing apparatus according to claim 9, wherein said control means changes at least one of a number of said plurality of split pulses, said split pulse-applying periods, and said quiescent periods interposed between said plurality of split pulses, to thereby control said temperature of said thermal head in a heated state.

11. A printing apparatus according to claim 10, wherein said control means controls said operation of said split pulse-applying means such that said temperature of said thermal head in said heated state is below a predetermined temperature.

12. A printing apparatus according to claim 11, including ribbon feed means for feeding said ink ribbon, and wherein said control means controls said ribbon feed means in a manner such that said feed speed of said ink ribbon is changed in response to said temperature of said thermal head detected by said temperature-detecting means.

13. A printing apparatus according to claim 11, wherein said predetermined temperature is a melting point of a material of a ribbon tape of said ink ribbon.

14. A printing apparatus according to claim 13, wherein said control means sets each of said quiescent periods to zero when said temperature of said thermal head detected by said temperature-detecting means is below a certain temperature lower said predetermined temperature.

15. A printing apparatus according to claim 11, wherein said control means sets each of said quiescent periods to zero when said temperature of said thermal head detected by said temperature-detecting means is below a certain temperature lower said predetermined temperature.

16. A printing apparatus according to claim 10, including ribbon feed means for feeding said ink ribbon, and wherein said control means controls said ribbon feed means in a manner such that said feed speed of said ink ribbon is changed in response to said temperature of said thermal head detected by said temperature-detecting means.

17. A printing apparatus according to claim 10, wherein said image includes various types which are different in print width, said control means further including pulse-applying time-correcting means for correcting said time period over which said strobe pulse is required to be applied, according to said print width.

18. A printing apparatus according to claim 9, wherein said image includes various types which are different in print width, said control means further including pulse-applying time-correcting means for correcting said time period over which said strobe pulse is required to be applied, according to said print width.

19. A method of making a mask pattern for exposure, by the use of said printing apparatus as claimed in claim 1, wherein heat is given to an ink ribbon comprising a transparent ribbon tape and ink coated thereon, in such an amount as enables thermal transfer of a portion of said ink to a printing object, to thereby form a mask pattern on said ink ribbon, said mask pattern being formed by a negative image of an image to be printed.

20. A method of making a mask pattern for exposure, by the use of said printing apparatus as claimed in claim 9, wherein heat is given to an ink ribbon comprising a transparent ribbon tape and ink coated thereon, in such an amount as enables thermal transfer of a portion of said ink to a printing object, to thereby form a mask pattern on said ink ribbon, said mask pattern being formed by a negative image of an image to be printed.

* * * * *